US009599417B2

(12) United States Patent
Kolev et al.

(10) Patent No.: US 9,599,417 B2
(45) Date of Patent: Mar. 21, 2017

(54) EXTRACTOR MECHANISM FOR FIREARM

(71) Applicant: Savage Arms, Inc., Westfield, MA (US)

(72) Inventors: Ivan Kolev, Broad Brook, CT (US); John Linscott, Holyoke, MA (US)

(73) Assignee: Savage Arms, Inc., Westfield, MS (US)

( * ) Notice: Subject to any disclaimer, the term of this patent is extended or adjusted under 35 U.S.C. 154(b) by 0 days.

(21) Appl. No.: 14/599,199

(22) Filed: Jan. 16, 2015

(65) Prior Publication Data

US 2015/0330731 A1 Nov. 19, 2015

Related U.S. Application Data

(60) Provisional application No. 61/993,541, filed on May 15, 2014, provisional application No. 61/993,563, (Continued)

(51) Int. Cl.

| | |
|---|---|
| ***F41A 15/14*** | (2006.01) |
| ***F41A 19/10*** | (2006.01) |
| ***F41A 19/12*** | (2006.01) |
| ***F41A 19/16*** | (2006.01) |
| ***F41A 3/12*** | (2006.01) |
| ***F41A 3/66*** | (2006.01) |
| ***F41A 19/27*** | (2006.01) |

(Continued)

(52) U.S. Cl.

CPC ..... *F41A 15/14* (2013.01); *F41A 3/12* (2013.01); *F41A 3/46* (2013.01); *F41A 3/66* (2013.01); *F41A 19/10* (2013.01); *F41A 19/12* (2013.01); *F41A 19/16* (2013.01); *F41A 19/27* (2013.01); *F41A 21/00* (2013.01); *F41A 17/46* (2013.01); *F41A 19/14* (2013.01)

(58) Field of Classification Search

CPC ..... F41A 15/12; F41A 15/14; F41A 15/16
USPC ..... 42/25
See application file for complete search history.

(56) References Cited

U.S. PATENT DOCUMENTS

| | | | |
|---|---|---|---|
| 1,410,270 | A | 3/1922 | Pedersen |
| 1,656,961 | A | 1/1928 | Soncini |

(Continued)

FOREIGN PATENT DOCUMENTS

| | | | |
|---|---|---|---|
| CH | 626717 A5 | | 11/1981 |
| DE | 102007034672 | * | 1/2008 |

(Continued)

OTHER PUBLICATIONS

Guns & Ammo Network, "Innovative, Remarkable, Reliable . . . Getting Inside Savage's Accutrigger". Sep. 23, 2010. Available online at: http://www.shootingtimes.com/long-guns/longgun_reviews_savage_0813/ (8 pgs.).

*Primary Examiner* — Stephen M Johnson
(74) *Attorney, Agent, or Firm* — Christensen Fonder PA

(57) ABSTRACT

An ejector mechanism for a firearm. The ejector mechanism includes a claw-type extractor disposed opposite a ledge portion that includes an inclined face, the inclined facing being oriented to face toward a bolt face to help secure a shell casing to the bolt face during the extraction process. The claw-type extractor and inclined face, while providing positive retention of the shell casing during ejection, also cooperate to enable the shell casing to be dislodged by an ejector.

8 Claims, 21 Drawing Sheets

Related U.S. Application Data filed on May 15, 2014, provisional application No. 61/993,569, filed on May 15, 2014.

(51) Int. Cl.

| | |
|---|---|
| ***F41A 21/00*** | (2006.01) |
| ***F41A 3/46*** | (2006.01) |
| *F41A 17/46* | (2006.01) |
| *F41A 19/14* | (2006.01) |

(56) References Cited

U.S. PATENT DOCUMENTS

| | | | | |
|---|---|---|---|---|
| 1,737,974 | A | 12/1929 | Pedersen | |
| 2,453,830 | A | 11/1948 | Chadwick et al. | |
| 2,465,749 | A | 3/1949 | Rataiczak | |
| 2,473,373 | A | 6/1949 | Howell | |
| 2,527,895 | A | 10/1950 | Tassan | |
| 2,576,973 | A | 12/1951 | Simpson | |
| 2,585,195 | A | 2/1952 | Walker | |
| 2,594,354 | A | 4/1952 | Schnepel | |
| 2,601,808 | A | 7/1952 | Clarke | |
| 2,603,019 | A | 7/1952 | Elkas | |
| 2,626,474 | A | 1/1953 | Lochhead | |
| 2,638,694 | A | 5/1953 | Morris | |
| 2,873,546 | A | 2/1959 | Allyn | |
| 2,912,779 | A * | 11/1959 | Catlin | F41A 15/12 42/25 |
| 2,921,502 | A | 1/1960 | Amsler | |
| 2,975,680 | A | 3/1961 | Wilson | |
| 3,235,993 | A * | 2/1966 | Magardo | F41A 15/12 42/25 |
| 3,292,492 | A | 12/1966 | Sturtevant | |
| 3,631,622 | A | 1/1972 | Walker et al. | |
| 3,738,223 | A | 6/1973 | Post et al. | |
| 3,848,510 | A | 11/1974 | Wolpert | |
| 3,857,325 | A | 12/1974 | Thomas | |
| 3,893,369 | A | 7/1975 | Benelli | |
| 4,069,607 | A | 1/1978 | Jurek | |
| 4,203,243 | A | 5/1980 | Hickman | |
| 4,270,295 | A | 6/1981 | Grehl | |
| 4,344,246 | A | 8/1982 | Bauman et al. | |
| 4,547,988 | A | 10/1985 | Nilsson | |
| 5,157,209 | A | 10/1992 | Dunn | |
| 5,655,326 | A | 8/1997 | Levavi et al. | |
| 5,666,754 | A | 9/1997 | de Oliveira Masina | |
| 5,760,328 | A | 6/1998 | Robbins | |
| 5,900,576 | A | 5/1999 | Gabriel | |
| 5,974,942 | A | 11/1999 | Dionne | |
| 6,256,918 | B1 | 7/2001 | Szabo | |
| 6,418,655 | B1 | 7/2002 | Kay | |
| 6,553,706 | B1 | 4/2003 | Gancarz et al. | |
| 6,782,791 | B2 | 8/2004 | Moore | |
| 7,204,051 | B2 | 4/2007 | Thomele et al. | |
| 8,122,633 | B2 * | 2/2012 | Kerbrat | F41A 1/08 42/20 |
| 8,220,193 | B1 | 7/2012 | Lynch | |
| 8,250,799 | B2 | 8/2012 | Duperry et al. | |
| 8,528,458 | B2 | 9/2013 | Windauer | |
| 2005/0257682 | A1 | 11/2005 | Hajjar et al. | |
| 2010/0024273 | A1 | 2/2010 | Duperry et al. | |
| 2010/0186581 | A1 | 7/2010 | Hajjar et al. | |
| 2010/0313459 | A1 | 12/2010 | Gomez | |
| 2011/0079137 | A1 | 4/2011 | Audibert et al. | |
| 2013/0074390 | A1 | 3/2013 | Wössner et al. | |
| 2013/0199069 | A1 | 8/2013 | Kerbrat et al. | |
| 2015/0330731 | A1 | 11/2015 | Kolev et al. | |

FOREIGN PATENT DOCUMENTS

| | | |
|---|---|---|
| DE | 102007034672 A1 | 1/2009 |
| EP | 0 017 506 | 10/1980 |
| WO | WO 94/09334 | 4/1994 |

* cited by examiner

EXTRACTOR MECHANISM FOR FIREARM

RELATED APPLICATIONS

This application claims the benefit of U.S. Provisional Patent Application Nos. 61/993,541, filed on May 15, 2014, 61/993,563, filed on May 15, 2014, and 61/993,569, filed on May 15, 2014, the disclosures of which are incorporated by reference herein in their entirety.

BACKGROUND OF THE DISCLOSURE

Firearm extraction mechanisms, particularly for semi-automatic firearms, often rely on a somewhat tenuous arrangement for securing a shell casing to a bolt of the firearm. The uncertainties associated with manufacturing tolerances of cartridges, as well as the spurious nature of the frictional forces exerted thereon, leads to instability during the extraction process that can cause failures to eject and sporadic ejection patterns. This can particularly be a problem when handling smaller diameter casings that are generally associated with rimfire cartridges (i.e., cartridges that are fired by impingement of a firing pin near the periphery of the base of the cartridge), particularly higher powered rimfire cartridges.

Also, the instability of traditional extractor mechanisms is more problematic when the retracting bolt speed is variable. Where the bolt is moved too slowly the cartridge case can become instable long before it's delivered to the ejector.

An ejector mechanism that overcomes these problems would be welcomed.

SUMMARY OF THE DISCLOSURE

Various embodiments of the disclosure provide a mechanism for stably securing a spent cartridge casing to a bolt assembly during extraction. In some embodiments, the same mechanism provides stability for a cartridge that is inserted onto a bolt assembly for the reloading process. In some embodiments, the extraction mechanism is tailored to accommodate high powered small caliber rounds, such as, for example, 0.17 Hornady Magnum Rimfire (0.17 HMR) and 0.17 Winchester Super Magnums (0.17 WSM) cartridges.

Various embodiments of the disclosure address the instability of traditional extractor mechanisms when the retracting bolt speed. Positive cartridge/casing retention of the extractor allows the system to not be speed dependent.

Structurally, an extraction mechanism for a firearm is disclosed, comprising a bolt assembly including a bolt with a bolt face, the bolt assembly being translatable along a central axis. A recess sized to accommodate the base of a cartridge is defined on the bolt face, the recess including a base surface on the bolt face, the base surface being substantially normal to the central axis. In various embodiments, the recess defines an access on a lateral face of the bolt. The access can be concentric about a lateral axis. A ledge portion partially surrounds the base surface of the bolt face, the ledge portion including an inclined face that defines a normal vector including an axial component parallel to the central axis that is directed toward the base surface. In various embodiments, the axial component is in the range of 40 degrees to 70 degrees inclusive from the normal vector. In one embodiment, a cross-section of the inclined face is substantially straight, so that the inclined face and the base surface define an acute angle therebetween. In one embodiment, the ledge portion includes an arcuate segment about the central axis, and can also include a substantially straight portion tangential to the arcuate segment. A retractable extractor can be disposed proximate the recess, the retractable extractor being extendable over the base surface. In one embodiment, a firing pin that selectively extends into the recess in a direction normal to the base surface.

The inclined face of the ridge enables the spent cartridge casing to be adequately secured to the bolt face, while enabling the spent cartridge casing to slide upward and outward from the recess when brought into contact with the ejector.

In various embodiments, a semi-automatic firearm is disclosed, comprising a barrel defining a chamber centered about a barrel axis for holding a rimfire cartridge and a bolt assembly operatively coupled to the barrel. The bolt assembly is movable along the barrel axis to an engagement position with the barrel and is adapted to discharge the rimfire cartridge. The bolt assembly can comprise a unitary bolt body having a distal end portion, the distal end portion defining a recess for receiving a head of a rimfire cartridge. The recess is bound by a base surface that is normal to the barrel axis, an undercut portion that extends distally from the recessed base surface, and a ledge portion distal to the undercut portion that protrudes radially inward toward the barrel axis relative to the undercut portion. The ledge portion defines a central axis and includes an inclined face that faces the base surface. In one embodiment, the inclined face presents a rearwardly facing partial frusto-conical surface for engaging an exposed portion of a rim of a rimfire cartridge in the recess. In various embodiments, the semi-automatic firearm is in combination with a rimfire cartridge.

In one embodiment, the recess sized for receiving a head of a rimfire cartridge. The base surface and undercut portion can be sized such that the head of the rimfire cartridge is slidable on the base surface in all radial directions from the central axis for positioning a rim of the rimfire cartridge to contact the inclined face of the ledge portion. In one embodiment, the barrel axis and the central axis are non-concentric for seating a rim of a rimfire cartridge against the inclined face of the ledge portion when the bolt assembly is in the engagement position with the barrel. An extractor can be pivotally engaged with the bolt body, the extractor having a hook portion biased toward the central axis and extending over the recess. The hook portion can configured for engagement with a spent cartridge casing to push a rim of the spent cartridge casing into engagement with the inclined face of the ledge portion.

In various embodiments, at least part of the ledge portion is diametrically opposite the extractor. In one embodiment, at least a portion of the ledge portion is opposite the extractor, the hook portion being positioned for engaging a case wall of a rimfire cartridge to slide the rimfire cartridge on the base surface of the recess to contact with the inclined face of the ledge portion. In some embodiments, the ledge portion defines an arcuate segment.

The semi-automatic firearm can further include a receiver operatively coupled to the barrel, the bolt assembly being movably engaged within the receiver, the firearm including an ejector member positioned in an opening of the bolt body for ejecting a spent cartridge casing from the recess when the bolt assembly moves rearwardly.

In one embodiment, the inclined face of the ledge portion defines an acute angle facing inwardly toward the central axis. In various embodiments, the acute angle can be in a range of 25 degrees to 85 degrees inclusive, 25 to 65 degrees inclusive, 35 to 60 degrees inclusive, 35 to 55 degrees inclusive, or 40 to 50 degrees inclusive. In various embodiments, the ledge portion extends at least 30 degrees and less than 180 degrees around the recess.

In some embodiments, the recess is sized for a .22 caliber or smaller cartridge. The bolt recess can be sized to enable movement of the head of the cartridge at least 4% of the diametric distance of a standard cartridge size at the head of the cartridge.

In various embodiments of the disclosure, a semi-automatic firearm is disclosed for firing rimfire ammunition, the firearm comprising including a barrel defining a chamber for receiving and firing a rimfire cartridge, a receiver operatively coupled to the barrel, and a bolt assembly operatively coupled to the receiver and adapted for loading, firing, and ejecting a rimfire cartridge. The bolt assembly is translatable rearwardly along a central axis to a rearward position for withdrawal of a cartridge casing from the chamber and ejection of the casing, the bolt assembly being translatable from the rearward position forwardly for loading a rimfire cartridge from a magazine into the chamber. The bolt assembly can comprise a bolt body with a forward bolt face, and a recess defined on the forward bolt face for receiving the head of a rimfire cartridge, the recess being proximally bound by a base surface on the bolt face, the base surface being substantially normal to the central axis, the recess surface being oversized compared to a head of a rimfire cartridge. In various embodiments, the recess defines an access on a lateral face of the bolt. The access can be concentric about a lateral axis that intersects the central axis at a right angle.

The bolt assembly can further include a ledge portion that partially surrounds the base surface of the bolt face, the ledge portion including an inclined face that defines a normal vector including an axial component parallel to the central axis that is directed toward the base surface. The axial component is in a range of 40 degrees and 70 degrees inclusive relative to the normal vector. A retractable extractor, such as a claw-type extractor, can be disposed proximate the recess, the retractable extractor being extendable over the base surface. In some embodiments, a firing pin, such as a rim-type firing pin, selectively extends into the recess in a direction normal to the base surface, the firing pin parallel to and non-concentric with the central axis to effect rimfiring of a rimfire cartridge.

The ledge portion optionally includes an arcuate segment and a substantially straight portion tangential to the arcuate segment. In one embodiment, the retractable extractor is substantially centered at a location diametrically opposed to a junction point of the straight portion and the arcuate segment.

In various embodiments of the disclosure, an extraction mechanism for a firearm is disclosed comprising a bolt assembly including a bolt with a bolt face, the bolt assembly being translatable along a central axis. A recess is defined on the bolt face, the recess being proximally bounded by a base surface on the bolt face, the base surface being substantially normal to the central axis. A ledge portion can partially surround the base surface of the bolt face, the ledge portion including an inclined face that defines a normal vector including an axial component parallel to the central axis that is directed toward the base surface. In some embodiments, the axial component is in the range of 40 degrees and 85 degrees inclusive from the normal vector.

In some embodiments, a retractable extractor is disposed proximate the recess, the retractable extractor being extendable over the base surface. In one embodiments, a firing pin that selectively extends into the recess in a direction normal to the base surface. Optionally, the bolt assembly defines an off-axis bore that is parallel to and non-concentric with the central axis, the firing pin being disposed in the off-axis bore, wherein the firing pin is a rim-type firing pin.

The ledge portion can an arcuate segment, the arcuate segment defining a radius about the central axis. The ledge portion optionally includes a substantially straight portion tangential to the arcuate segment, wherein the retractable extractor is substantially centered at a location diametrically opposed to a junction point of the straight portion and the arcuate segments.

In some embodiments, there is a firing chamber distal to the bolt assembly, the firing chamber being concentric about a barrel axis. Optionally, the firing chamber includes structure defining a circular access opening and a ridge, the ridge including an edge that is immediately adjacent the circular access opening, wherein the retractable extractor engages the ridge to rotate the retractable extractor away from the recess when the firearm is in a firing position. The central axis and the barrel axis can be parallel and non-concentric. In one embodiment, the central axis and the barrel axis are spaced apart and the ledge portion is dimensioned for engagement of a cartridge rim with the inclined face of the ledge portion when the firearm is in a firing configuration.

In various embodiments of the disclosure, a firearm is disclosed, comprising a firing chamber distal to the bolt assembly, the firing chamber being concentric about a barrel axis; a bolt assembly including a bolt with a bolt face, the bolt assembly being translatable along a central axis, the central axis and the barrel axis being substantially parallel and non-concentric; a recess defined on the bolt face, the recess being proximally bounded by a base surface on the bolt face, the base surface being substantially normal to the central axis; and a ledge portion and an undercut portion that partially surrounds the base surface of the bolt face, the ledge portion extending towards the central axis relative to the undercut portion and defining an inclined face that faces the base surface, the ledge portion including an arcuate segment, the arcuate segment defining a radius centered about the central axis. The ledge portion is dimensioned and the central axis and the barrel axis are spaced apart for engagement of a cartridge rim with the inclined face of the ledge portion when the bolt is engaged with the firing chamber in a firing configuration. The inclined face of the ledge portion can define a frusto-conical headspace. Optionally, the inclined face can define a profile that is arcuate and convex.

In various embodiments, a method for extracting a spent cartridge casing from a firing chamber of a firearm includes providing a bolt translatable along a central axis and including a bolt face, a recess defined on the bolt face that includes a base surface that is substantially normal to the central axis, a ledge portion that partially surrounds the base surface, the ledge portion including an inclined face that defines a normal vector including an axial component parallel to the central axis that is directed toward the base surface, and a retractable extractor disposed proximate the recess that is extendable over the base surface; and causing the retractable extractor to extend over the base surface as the bolt is translated away from the firing chamber for engagement with the spent cartridge casing, the engagement of the shell casing causing a rim portion of the spent cartridge casing to engage the inclined face of the ledge portion, thereby capturing the rim portion of the shell casing.

DETAILED DESCRIPTION

Figure 1A:
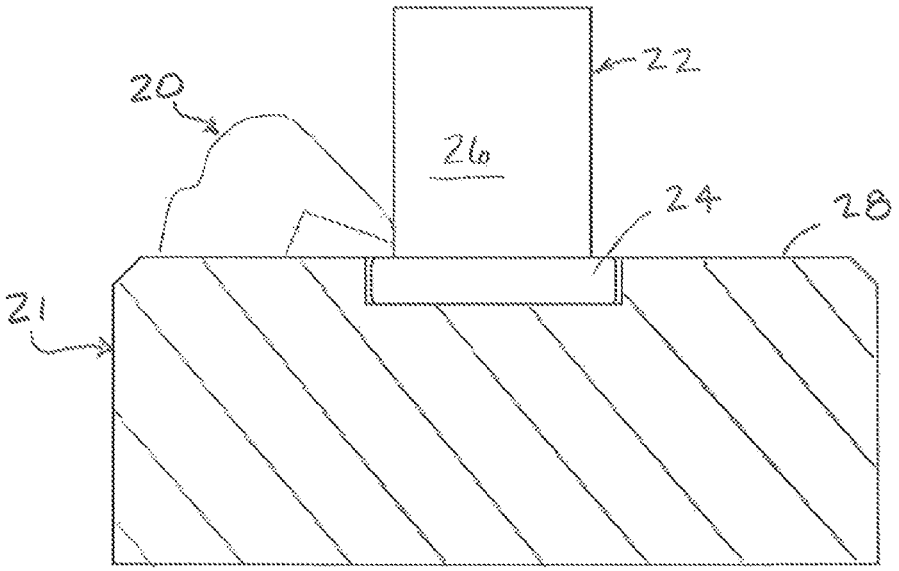
FIG. 1A PRIOR ART
FIGS. 1A and 1B are sectional views of a conventional rotating claw extractor in operation.
Figure 1B:
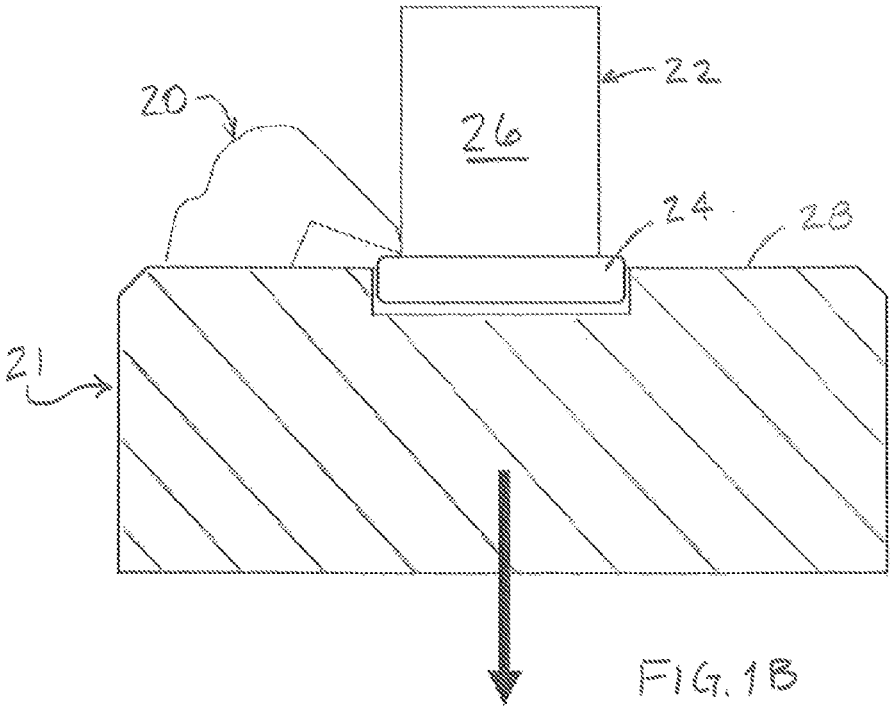
FIG. 1B PRIOR ART
Figure 2:
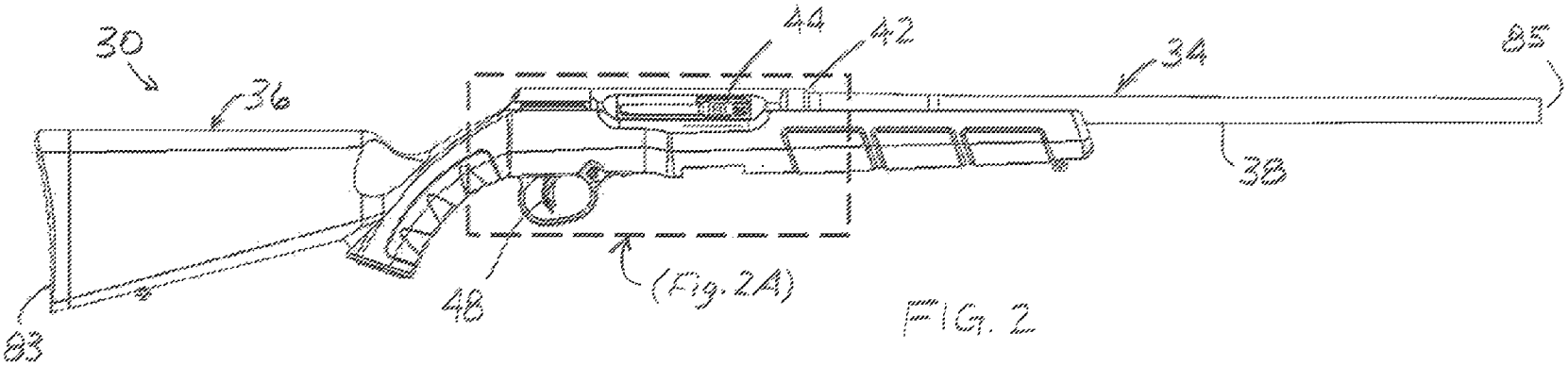
FIG. 2 is a side view of a firearm utilizing an extraction mechanism in an embodiment of the disclosure.
Figure 2A:
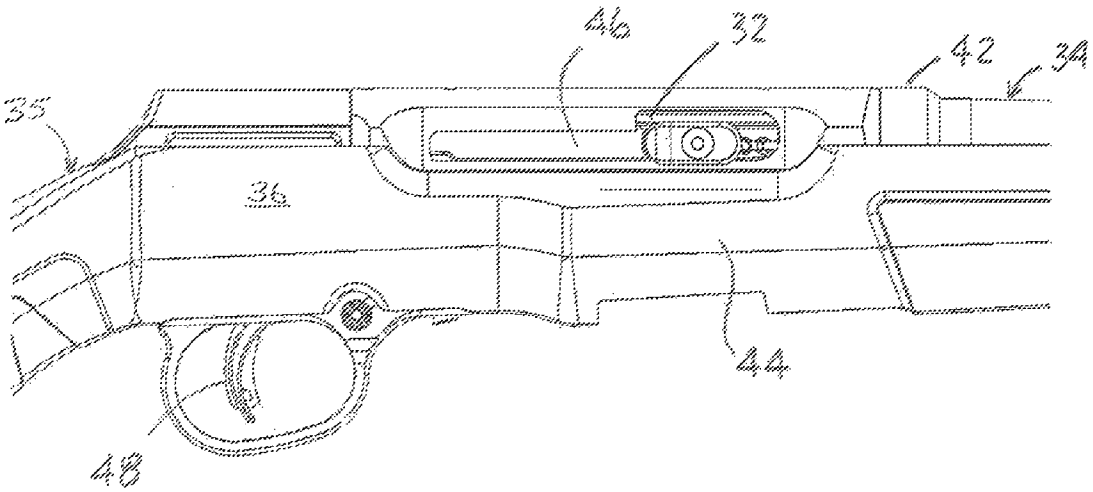
FIG. 2A is an enlarged partial view of the firearm of FIG. 2.
Figure 3:
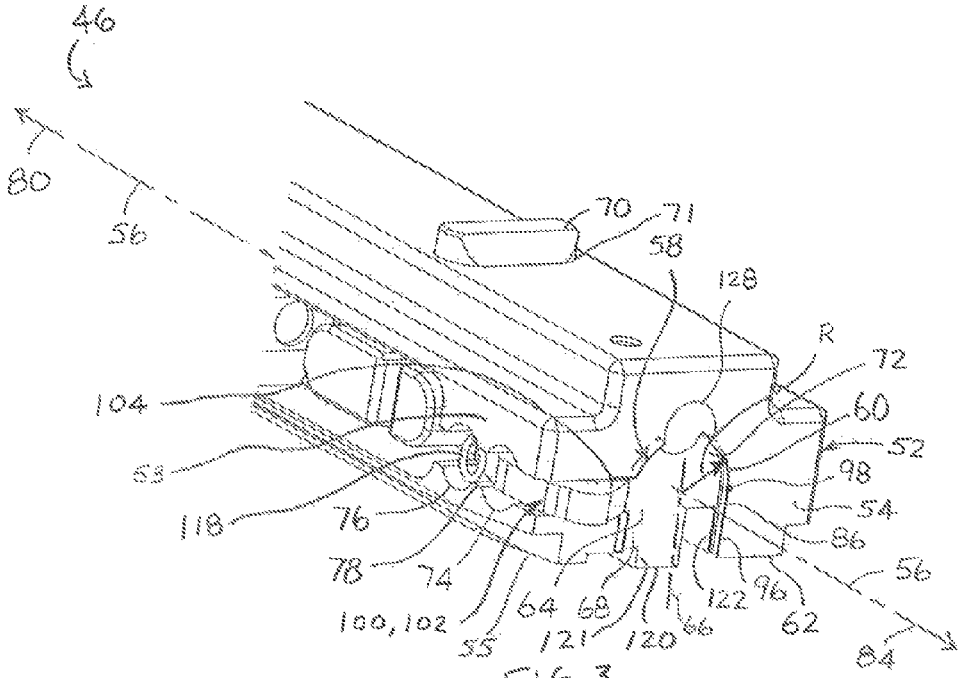
FIG. 3 is a bolt assembly in an embodiment of the disclosure.
Figure 4:
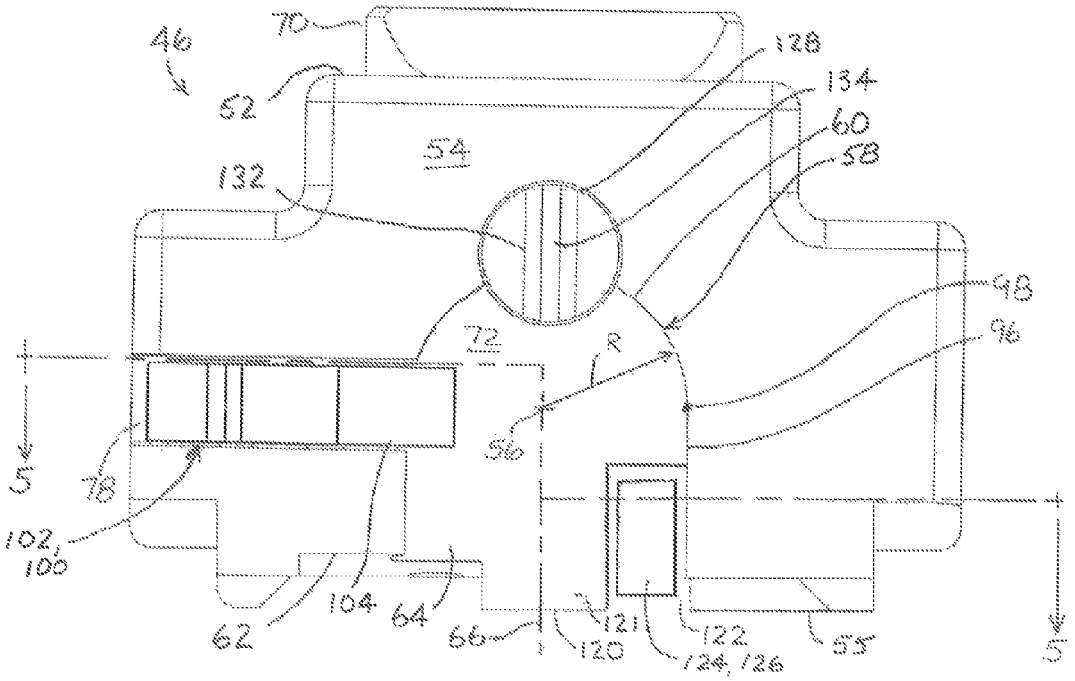
FIG. 4 is an elevation view of a distal end of the bolt assembly of FIG. 3.

Referring to FIGS. 1A and 1B, a conventional rotating claw extractor 20 operatively coupled to a bolt 21 is depicted. The extractor 20 rotates into contact with a shell casing 22 having a case rim 24 and a case wall 26, often making contact the case wall 26 (FIG. 1A). In this position, the extractor 20 exerts no force directly against the case rim 24. During extraction, a face 28 of the bolt 21 moves away from the shell casing 22 until the extractor 20 contacts the rim 24. Positive extraction is realized because the extractor 20 exhibits a force on the case rim 24.

However, due to the size and shape of cartridges such as rim fire cartridges and in particular high powered rim fire cartridges, ejection can be problematic, for example in semi-automatic firearms. Ejection can become compromised because once the shell casing 22 is extracted from the firing chamber it is not in static equilibrium and is no longer stable (FIG. 1B). That is, positive axial force is exerted asymmetrically, on only one portion of the case rim 24. The natures of the forces exerted on the shell casing 22 are further complicated by dimensional uncertainties due to the manufacturing tolerances of the shell casing as well as the generally small dimensions. If these manufacturing tolerances cause the contact edge of the extractor 20 to rotate into the headspace of the bolt face 28, the clearance can be inadequate for the extractor 20 to secure the case rim 24. Additionally, if the contact edge of the extractor 20 is near the headspace, feeding problems can occur as the case rim 24 may get bound on the extractor 20. If dimensional uncertainties of the shell casing 22 due to manufacturing tolerances cause the extractor to be displaced away from the headspace, the cartridge will again become unstable, as depicted in FIG. 1B.

It is further noted while other portions of the case rim 24, particularly portions that are diametrically opposed to the contact region of the rotating claw 20, can also be subject to an axial force, these axial forces rely on friction that results from radial counter forces exerted on the case rim 24. The frictional forces can be inconsistent, particularly when the surfaces involved are oiled, as is common practice with well-maintained firearms, or there is a buildup of discharge residue.

Referring to FIGS. 2 through 6G, a firearm 30 utilizing an extraction mechanism 32 for extraction of spent cartridge casings therefrom is depicted in an embodiment of the disclosure. The firearm 30 is a hand-held device that includes a barrel assembly 34 mounted in a stock 35 and operatively coupled to a receiver 36. The barrel assembly 34 includes a barrel 38 with a firing chamber 42, a breech 44, and a bolt assembly 46 slidingly engaged within the breech 44. A trigger assembly 48 is operatively coupled with the bolt assembly 46.

Various components of the bolt assembly 46 are part of the extraction mechanism 32. The extraction mechanism 32 includes a bolt 52 having a bolt face 54 at a distal end 53 and a lower face 55. A recess 58 is defined on the bolt face 54. In various embodiments, the structure defining the recess 58 includes an undercut portion 87 that extends distally to a ledge portion 86, the ledge portion 86 having an arcuate segment 60 that arcs tangentially about a central axis 56 that is normal to the base surface 72. (Herein, an "axis" extends indefinitely in two opposing directions, and is not bound lengthwise by the object or feature that defines the axis.)

In one embodiment, the arcuate segment 60 defines the location of the central axis 56 on the base surface 72, the arcuate segment 60 of the ledge portion 86 being at a constant radius R from the central axis 56. The bolt 52 being translatable parallel to the central axis 56. The recess 58 can extend through a lateral periphery 62 of the bolt 52, effectively defining a channel 64 that extends along a channel axis 66 and defining a channel opening 68 at the lateral periphery 62. The recess 58 can be bounded proximally by a base surface 72 on the bolt face 54. The base surface 72 is substantially normal to the central axis 56. The bolt assembly 46 can further include a retractable anchoring bar 70 that extends away from the central axis 56 through an aperture 71 formed in the bolt 52.

Figure 5A:
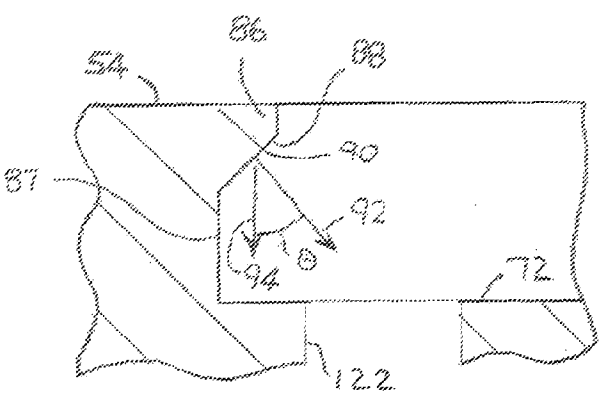
FIG. 5A is an enlarged, partial sectional view of the bolt assembly of FIG. 5.

The bolt 52 can also include structure defining a first lateral bore 74 and a second lateral bore 76 proximate the bolt face 54, the second lateral bore 76 being proximal (rearward) to the first lateral bore 74. An extractor channel 78 can be formed on the distal (forward) end portion 53 of the bolt 52, the extractor channel 78 extending parallel to the central axis 56 and passing through both the first and second lateral bores 74 and 76. (Herein, "proximal" and "forward" refer to a direction 80 that is towards a butt end 83 of the stock, and "distal" and "rearward" refer to a direction 84 that is towards a discharge end 85 of the barrel 38.) The ledge portion 86 and undercut portion 87 partially surrounds the base surface 72 of the bolt face 54. The ledge portion 86 includes an inclined face 88 that faces the base surface 72 defines a normal vector 92 (FIG. 5A) that, during contact with a rim 148 of a casing 144 disposed in the recess 58, correlates with a retention force exerted thereon. The normal vector 92 includes an axial component 94 that is parallel to the central axis 56 and is directed toward the base surface 72. The axial component 94 of the normal vector 92 can define an angle θ relative to the normal vector 92. In various embodiments, the angle ∂ is in the range of 25° to 85° inclusive. (Herein, a range that is said to be "inclusive" includes the end point values of the stated range, as well as the values between the end point values.) In one embodiment, the ledge portion 86 and undercut portion 87 include a substantially straight portion 96 that is tangential to the arcuate segment 60 at a junction point 98. In one embodiment, the inclined face 88 of the arcuate segment 60 is substantially linear in cross-section, to define a frustum shaped profile 90 (FIG. 5A).

Figure 5B:
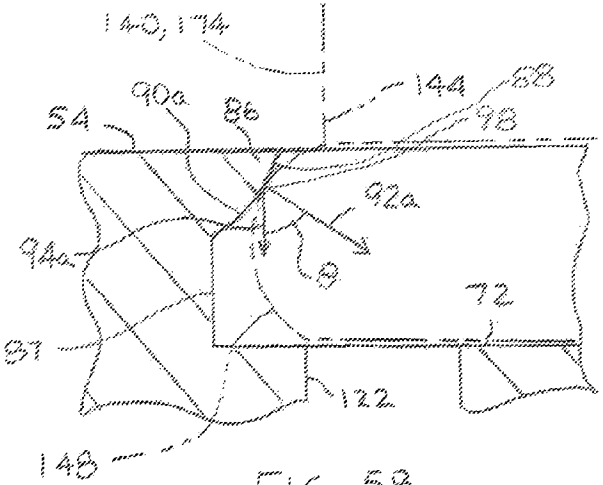
FIG. 5B is an enlarged, partial sectional view of the bolt assembly in an alternative embodiment of the disclosure.
Figure 5:
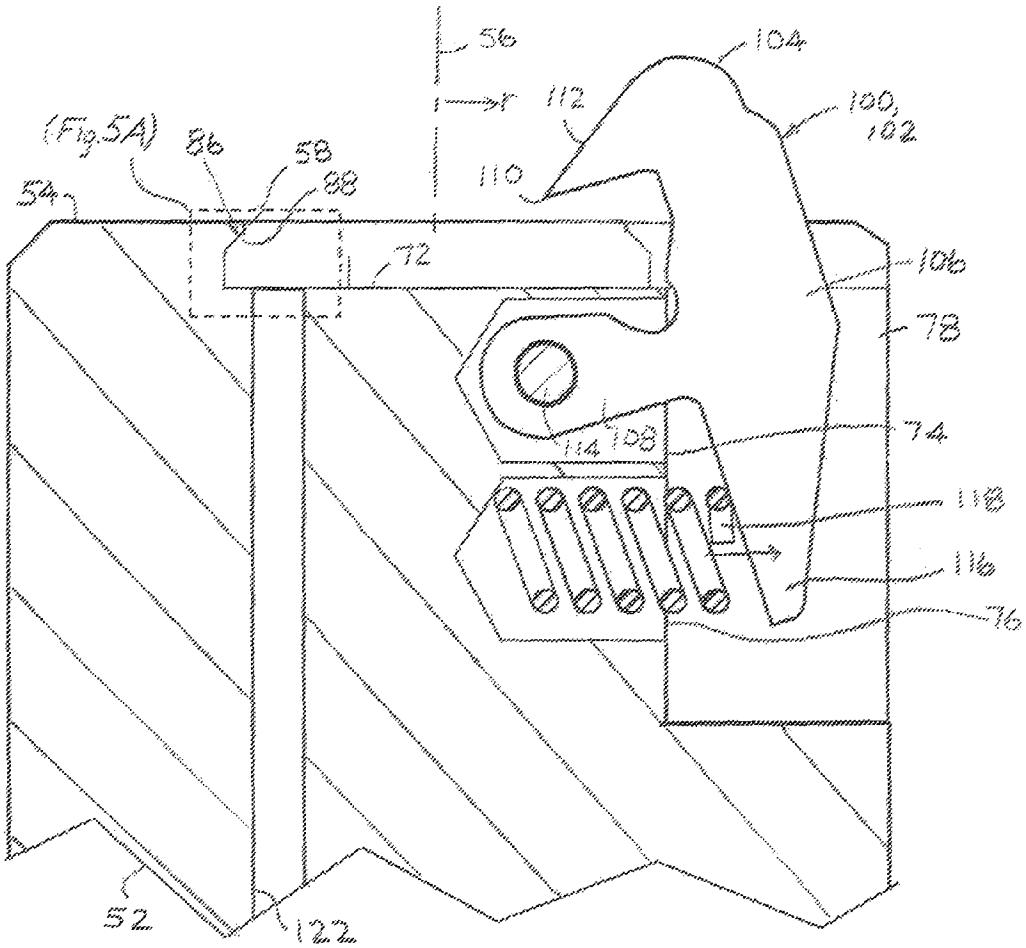
FIG. 5 is a sectional view of the bolt assembly of FIG. 4.

Alternatively, the ledge portion 86 can be configured to define other profile shapes. In one embodiment, the ledge portion 86 includes an arcuate, convex-shaped profile 90*a* (FIG. 5B). In this embodiment, a normal vector 92*a* is defined by the contact line between the rim 148 of the spent cartridge casing 174 or cartridge 140 and the convex-shaped profile 90*a*. (The rim 148 and casing 144 of the spent cartridge casing 174 or cartridge 140 is depicted in phantom in FIG. 5B.) An axial component 94*a* of the normal vector 92*a* extends parallel to the central axis 56. The extraction mechanism 32 also includes a retractable extractor 100. In some embodiment, the retractable extractor 100 is diametrically opposed to the junction point 98 about the central axis 56. In one embodiment, the retractable extractor 100 is centered at this location. In one embodiment, the retractable extractor 100 is a claw-type extractor 102 having a claw portion 104, a stem portion 106, and a pivot arm portion 108. The claw-type extractor 102 is disposed in the extractor channel 78 proximate the recess 58, with the claw portion 104 is extendable over the recess 58 and/or base surface 72. The claw portion 104 can define an apex 110 at a radially innermost extremity, and a tapered distal face 112 that slopes distally and away from the apex 110 with increasing radial distance r from the central axis 56.

The apex 110 may be in axial alignment (with respect to the firearm) with pin 114. This minimizes rotation or disengagement of the cartridge rim from the force of the cartridge rim during extraction, enabling the extractor spring to be of minimal force.

The pivot arm portion 108 of the claw-type extractor 102 can extend into the first lateral bore 74 and can be pivotally coupled to a pivot pin 114 that extends laterally into or through the first lateral bore 74. A proximal end 116 of the of the stem portion 106 of the claw-type extractor 102 can extend proximal to the pivot arm portion 108 and be disposed within the second lateral bore 76, with a biasing element 118 (e.g., a spring) disposed within the second lateral bore 76. In one embodiment, the biasing element 118 exerts a force FB radially outward on the proximal end 116 of the of the stem portion 106 of the claw-type extractor 102, such that, in a default configuration, the proximal end 116 of the claw-type retractable extractor 102 is biased in a rotational position about the pivot pin 114 that extends the claw portion 104 of the claw-type retractable extractor 102 over the recess 58.

In one embodiment, the bolt 52 includes a magazine rail 120 that is defined on the lower face 55 of the bolt 52 and extends substantially parallel to the central axis 56 along the lower face 55. The magazine rail 120 includes a distal face 121 that protrudes downward and can be substantially centered about the channel axis 66.

The lower face 55 of the bolt 52 can further define an ejector channel 122 within which a stationary ejector 124 is mounted, the stationary ejector 124 being stationary relative to the firearm 30 and including a distal end 126. The ejector channel 122 extends substantially parallel to the central axis 56 and through the base surface 72 of the bolt face 54. The bolt 52 can also include a firing pin channel or passage 128, within which a firing pin 132 can be slidingly engaged. The firing pin 132 includes a distal end 134 that is selectively extensible into the recess 58 in a direction normal to the base surface 72. In one embodiment, the firing pin 132 is a rim-type firing pin.

Figure 5C:
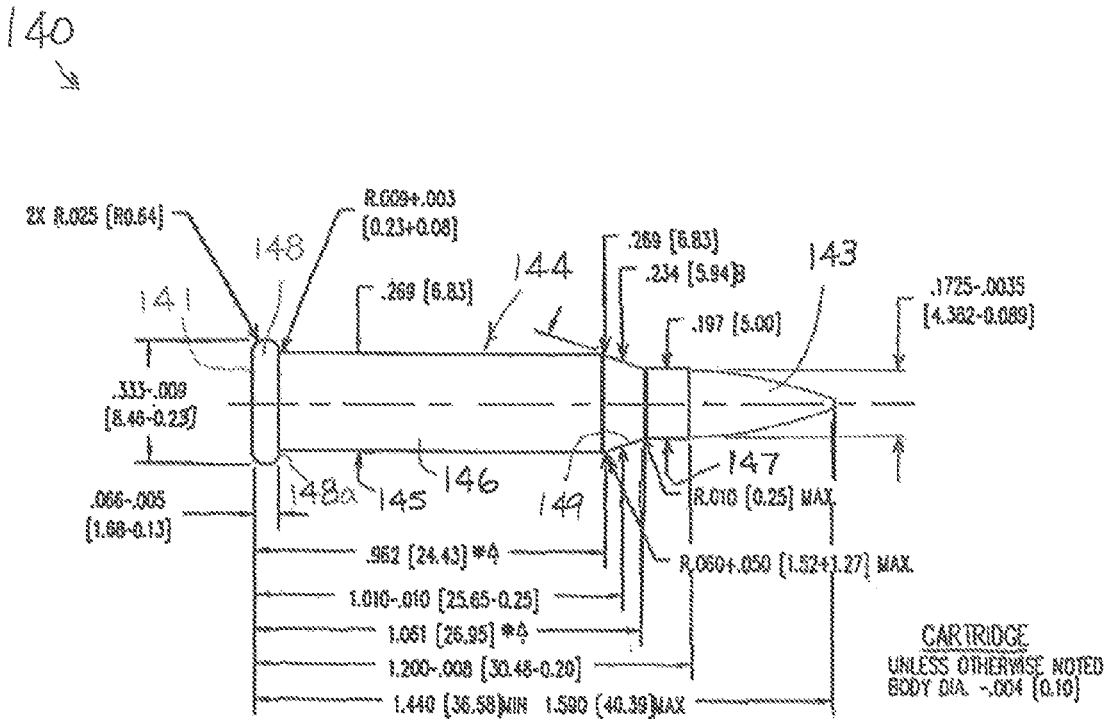
FIG. 5C PRIOR ART
FIG. 5C is an elevation view of a cartridge, including dimensions for a 0.17 WSM cartridge.

The firing chamber 42 includes chamber wall 136 that defines a cylindrical interior chamber 138 centered about a barrel axis 139 and having a circular access opening 142 that faces the breech 44, and within which a cartridge 140 can be mounted and discharged. When mounted in the chamber, the rim 148 is proximal to the bullet 143. The cartridge 140 is characterized as having the casing 144 that includes a body or case wall 146, a head 141 having the rim 148, and a bullet 143. The rim 148 is further characterized as defining a forward side 148*a*. The rim 148 is depicted as being of greater diameter than the case wall 146. Standard cartridges of this variety, which are often rimfire cartridges, include the 0.22 short, the 0.22 long rifle, and the 0.22 Winchester Magnum Rimfire (0.22 WMR). In certain embodiments, the casing 144 is of the shouldered variety, having a major diameter 145 and a minor diameter or neck 147 joined by a tapered shoulder 149 (FIG. 5C). Non-limiting examples of shouldered standard cartridges include the 0.17 Hornady Magnum Rimfire (0.17 HMR) and 0.17 Winchester Super Magnums (0.17 WSM) cartridges. The dimensional specifications for the 0.17 WSM are also depicted in FIG. 5C, and presented only as example dimensions of the cartridge 140.

Alternatively, the extraction mechanism 32 can be tailored to extract standard "rimless bottleneck" cartridges with heads that are of approximately the same or smaller diameter as the body for casings where the head projects outward relative to a reduced diameter of the body at the body/rim junction. That is, the head of a rimless bottleneck cartridge does not extend radially beyond the radius of the case wall. Standard cartridges of this variety include, but are not limited to, the 0.22 Remington and the 0.17 Remington, which are both centerfire cartridges.

In one embodiment, a ridge 152 can be formed at a proximal end 154 of the firing chamber 42. The ridge 152 defines an edge 156 that is immediately adjacent the circular access opening 142, such that when the cartridge 140 is mounted in the firing chamber 42, an exposed portion 158 of the rim 148 extends radially outward relative to the edge 156 of the ridge 152. In some embodiments, the edge 156 of the ridge 152 is tangential to the circular access opening 142.

Referring again to FIGS. 6A through 6H, operation of the extraction mechanism 32 is described in the context of a semi-automatic firearm in an embodiment of the disclosure. In a firing position 172 (FIGS. 6A through 6C), the cartridge 140 is disposed in the firing chamber 42 of the firearm 30. In the firing position 172, in one embodiment, the tapered distal face 112 of the claw-type extractor 102 is engaged with the ridge 152 of the firing chamber 42, such that the claw portion 104 of the claw-type extractor 102 is pushed radially outward.

The radial outward displacement of the claw portion 104 causes the claw-type extractor 102 to rotate about the pivot pin 114, such that the proximal end 116 of the stem 106 is rotated radially inward against the biasing element 118. In this way, the claw-type extractor 102 refracted, so that the claw portion 104 is clear of the cartridge 140 and enabling the rim 148 of the casing 144 to be registered against the circular access opening 142 of the firing chamber 42.

Figure 6A:
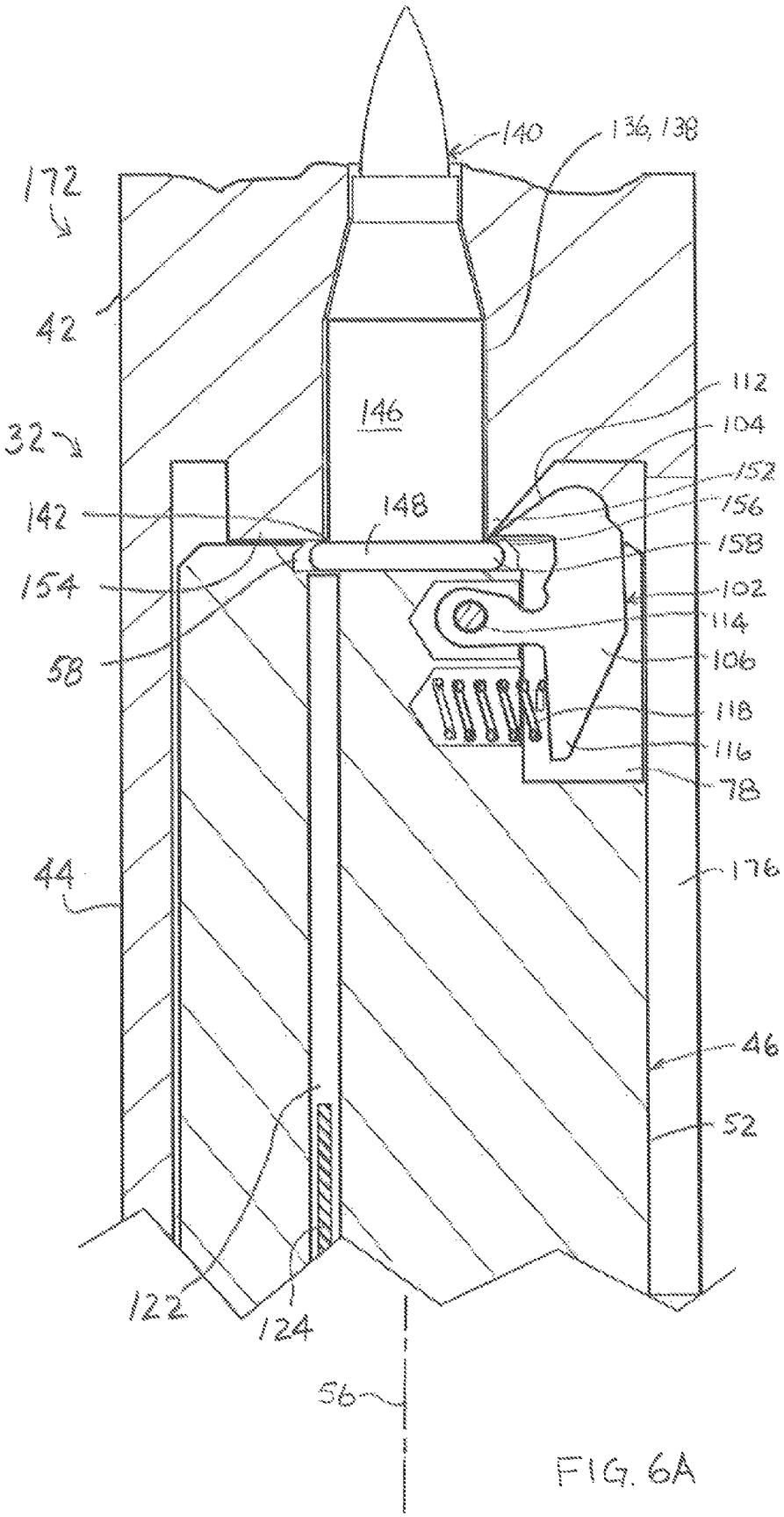
FIGS. 6A and 6B are plan sectional and elevation sectional views, respectively, of the bolt assembly, breech, and firing chamber in a firing position in an embodiment of the disclosure
Figure 6B:
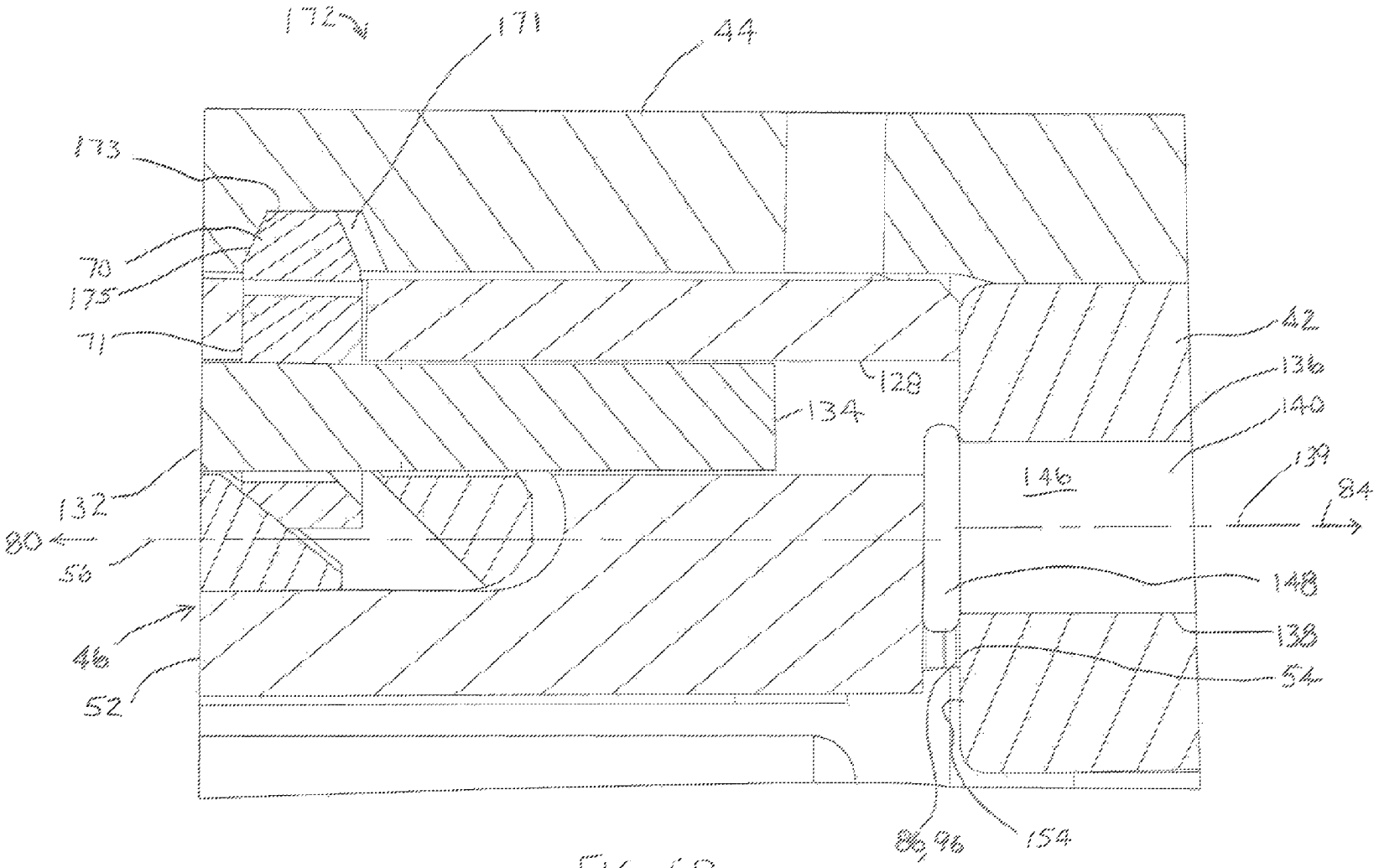

In various embodiments, the central axis 56 of the recess 58 is parallel to, but not concentric with, the barrel axis 139, as best seen in FIG. 6B. In these embodiments, an outer radius Rr of the rim 148 at least partially overlaps with the radius R of the arcuate segment 60 of the ledge portion 86, such that when the cartridge 140 is chambered in the firing position 172, the rim 148 is partially captured by the ledge portion 86.

In one embodiment, when in the firing position 172, the retractable anchoring bar 70 extends into an anchoring slot 171 formed in the breech 44, such that a proximal face 173 of the anchoring bar 70 registers against a distal face 175 of the anchoring slot 171. In one embodiment, the location and configuration of the anchoring slot 171 is such that, when the anchoring bar 70 is registered therein in the firing position 172, the bolt face 54 is in pressing contact with the proximal end 154 of the firing chamber 42.

Upon discharge, a spent cartridge casing 174 is present in the firing chamber 42. For a semi-automatic firearm, the bolt assembly 46 is disengaged from the firing chamber 42 by a blowback force FB that also exerts a pressure on the spent cartridge casing 174 that forces the head 141 of the casing 144 against the base surface 72 of the bolt face 54. The blowback force FB causes the bolt assembly 46 to translate parallel to the central axis 56 away from the firing chamber 42. As the bolt assembly 46 is translated away from the firing chamber 42, the claw portion 104 of the claw-like extractor 102 is rotated radially inward, motivated by the biasing element 118 acting on the proximal end 116 of the claw-like extractor 102 (FIG. 6B). The tapered distal face 112 of the claw portion 104 slides on the edge 156 of the ridge 152 of the firing chamber 42, until the apex 110 of the claw portion 104 engages the exposed portion of the rim 148 of the spent cartridge casing 174, thereby hooking the spent cartridge casing 174.

Figure 6C:
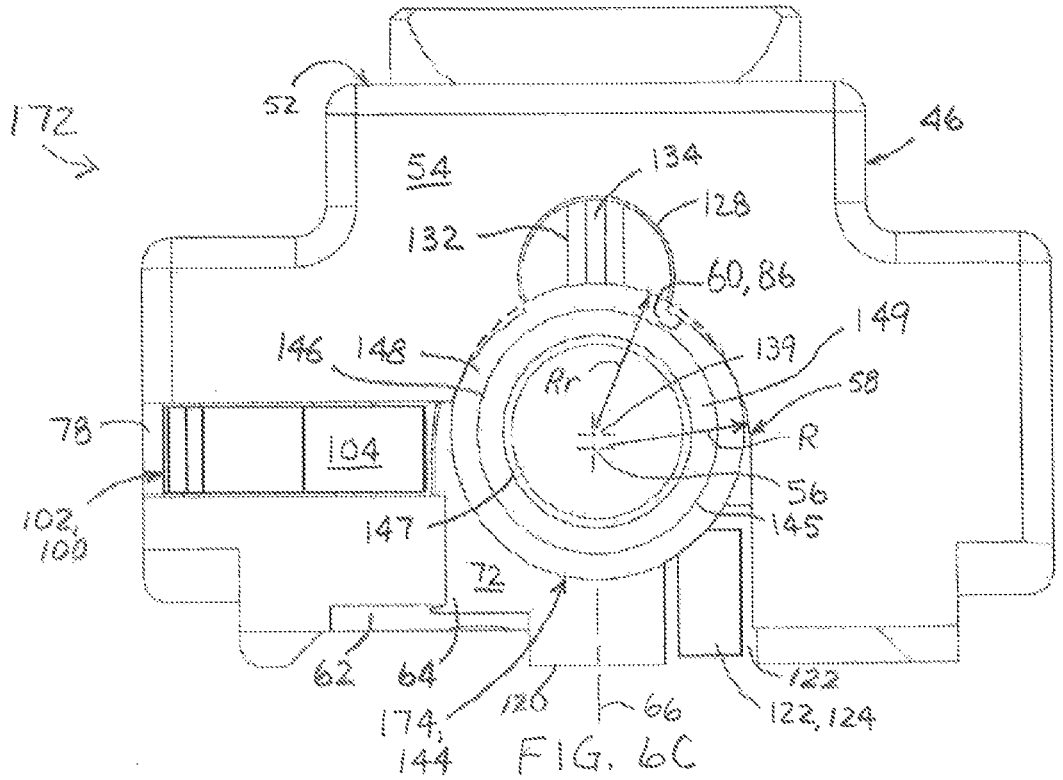
FIG. 6C is a front view of the bolt assembly with a cartridge in the firing position in an embodiment of the disclosure.
Figure 6G:
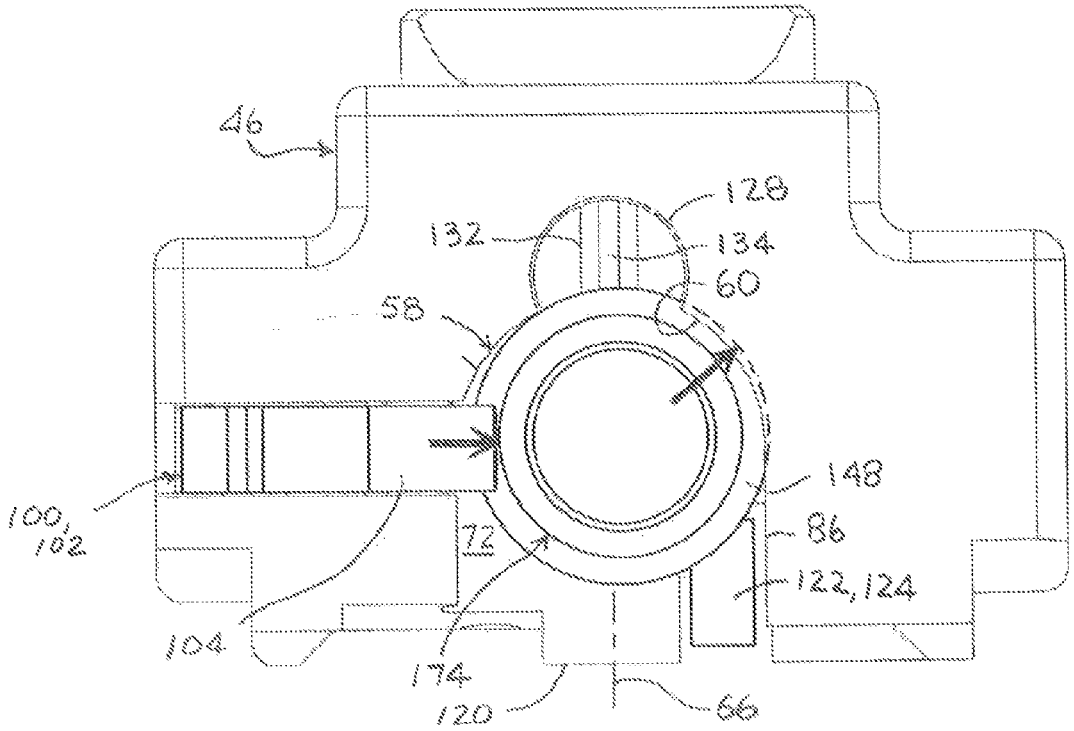
FIG. 6G is a front view of the bolt assembly with a spent cartridge casing secured thereto and corresponding to FIGS. 6F and 7B in an embodiment of the disclosure.

As the bolt assembly 46 is translated in the proximal direction 80, the apex 110 of the claw portion 104 exerts an axial force FCa against the exposed portion of the rim 148, thereby extracting the spent cartridge casing 174 from the firing chamber 42 (FIG. 6C). Initially, the blowback force can continue to exert the blowback force FB and assist in keeping the spent cartridge casing 174 seated against the base surface 72 of the bolt face 54, as pressure can remain in the firing chamber 42 during the initial stages of the extraction. The claw portion 104 also exerts a radial inward force FCr on the spent cartridge casing 174. As the spent cartridge casing 174 is translated out of the firing chamber 42, the radial inward force FCr exerted by the apex 110 of the claw portion 104 of the extractor can cause the spent cartridge casing 174 to shift laterally toward the ledge portion 86, so that the rim 148 of the spent cartridge casing 174 registers against the inclined face 88 of the ledge portion 86. The lateral shifting of the spent cartridge casing 174 can cause the claw-like extractor 102 to further rotate about the pivot pin 114, which in turn can cause the apex 110 of the claw portion 104 to move both radially inward and axially away from the bolt face 54.

Figure 6D:
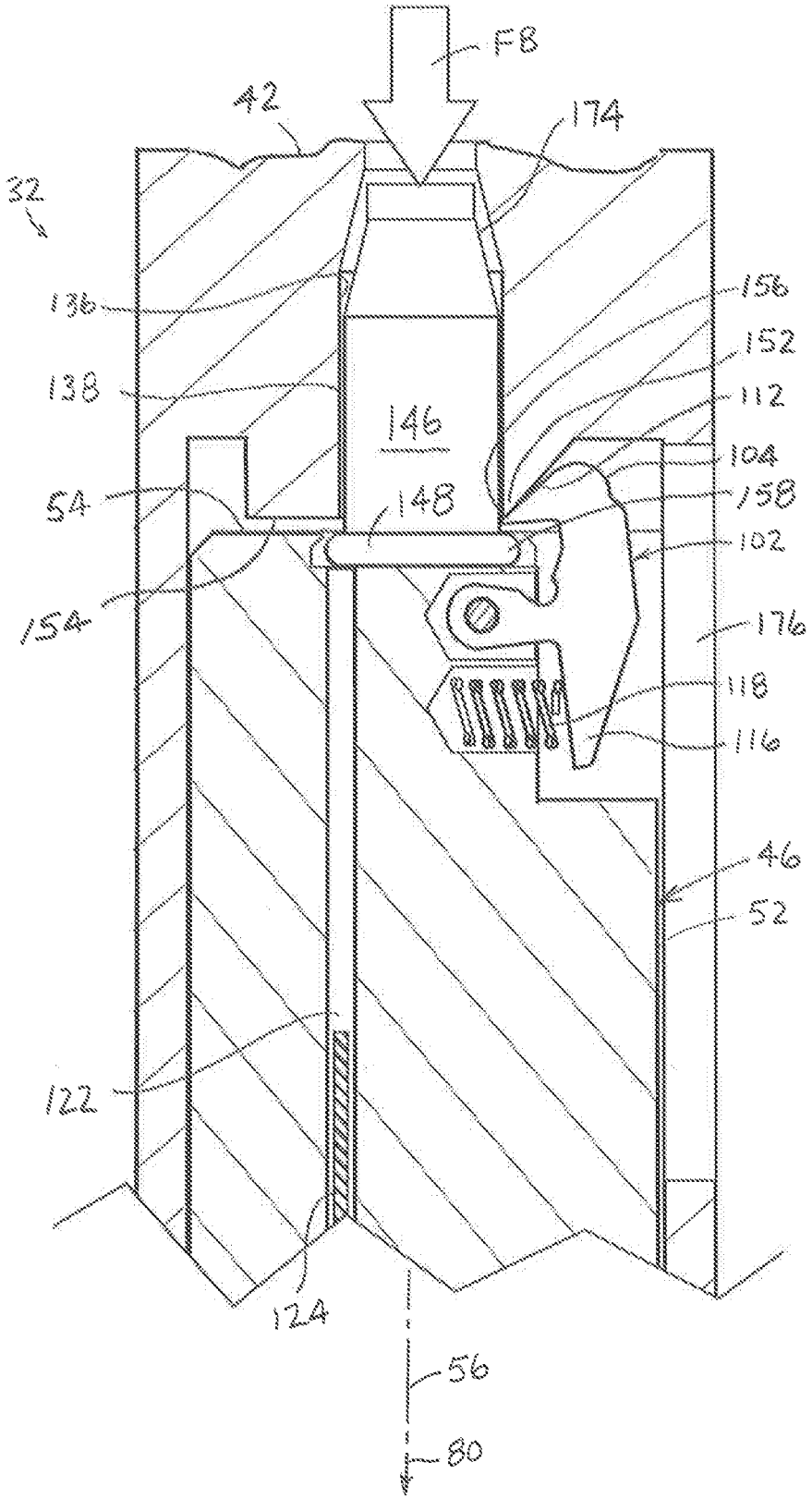
FIGS. 6D through 6F are sectional views of the bolt assembly, breech, and firing chamber for an extraction utilizing a blowback force at various stages of extraction in an embodiment of the disclosure.

As the major diameter 145 of the spent cartridge casing 174 is extracted in the proximal direction 80, the firing chamber 42, the interior chamber 138 of the firing chamber is vented, eliminating the blowback force FB (FIG. 6D). At this stage of the extraction, the forces exerted on the spent cartridge casing 174 include the radial inward force FCr exerted at the claw portion 104, and a ledge force FL, the ledge force FL having a radial inward component FLr and an axial component FLa, the axial component FLa acting in the proximal direction 80. The axial component FLa secures the spent cartridge casing 174 against the base surface 72 of the bolt face 54 as the bolt assembly 46 is translated within the breech 44.

Figure 6E:
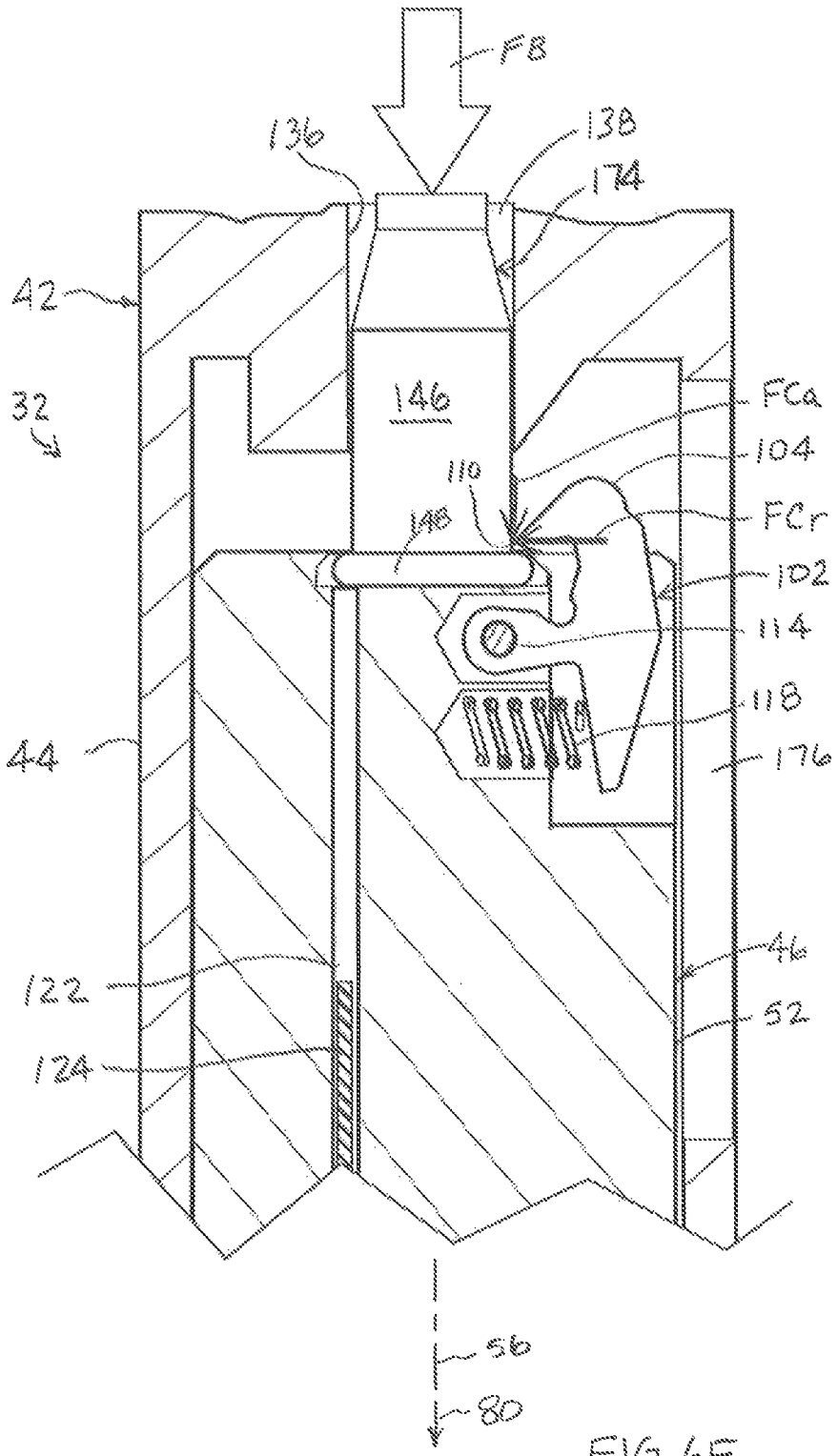
Figure 6F:
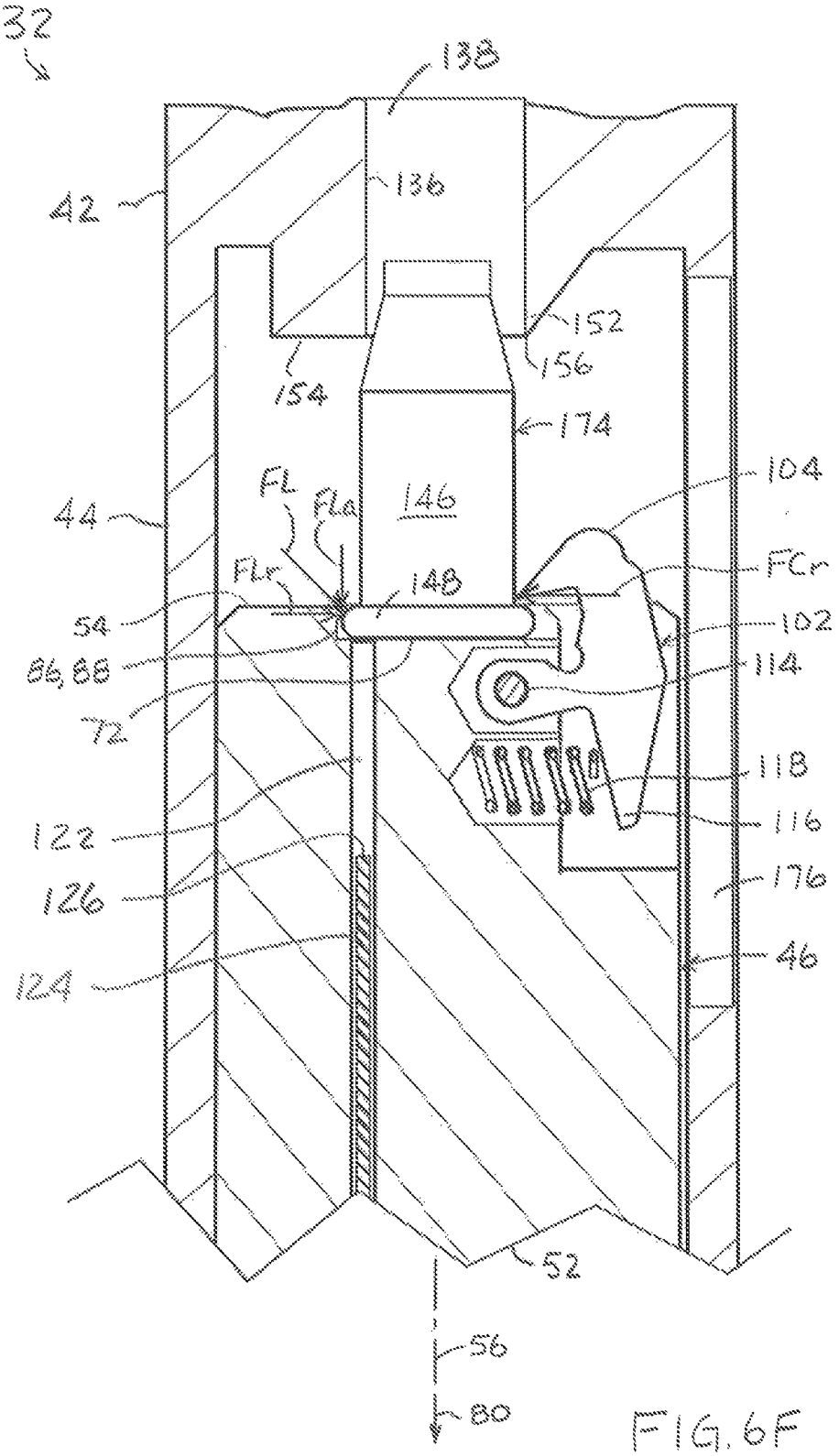
Figure 6H:
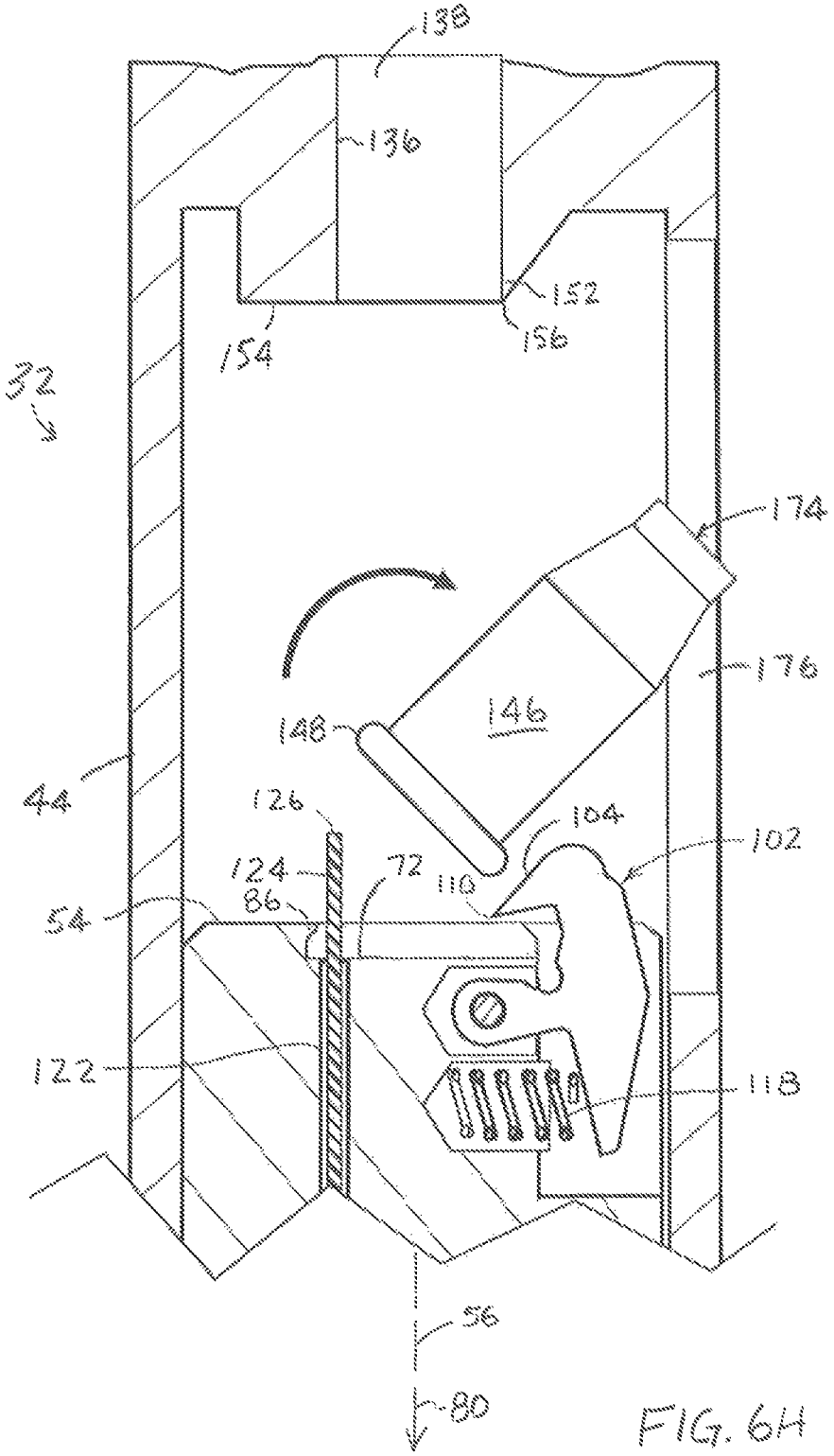
FIG. 6H is a sectional view of the bolt assembly, breech, and firing chamber during ejection of the spent cartridge casing in an embodiment of the disclosure.

Momentum from the blowback of the discharge continues to translate bolt assembly 46 parallel to the central axis 56 in the proximal direction 80, with the base surface 72 of the bolt face 54 eventually reaching the distal end 126 of the stationary ejector 124 (FIG. 6E) so that the distal end 126 of the stationary ejector 124 extends into and/or through the recess 58. The protrusion of the stationary ejector 124 into the recess 58 projects the spent cartridge casing 174 distally away from the base surface 72. This distal motion causes the rim 148 of the spent cartridge casing 174 to slide along the inclined face 88 of the ledge portion 86 in the distal direction 84, which causes the spent cartridge casing 174 to move laterally against the claw portion 104 of the claw-type extractor 102. The claw-type extractor 102 accommodates this lateral movement by rotating radially outward, but maintains contact with the spent cartridge casing because of the bias force exerted on the claw-type extractor 102 by the biasing element 118. As the rim 148 of the spent cartridge casing 74 clears the ledge portion 86, the rim 148 initially remains engaged with the apex 110 of the claw portion 104, causing the spent cartridge casing 174 to pivot about the apex 110. The spent cartridge casing then rotates laterally away from the apex 110 and out of the breach 44 via an ejection window 176 (FIG. 6E).

Figure 7A:
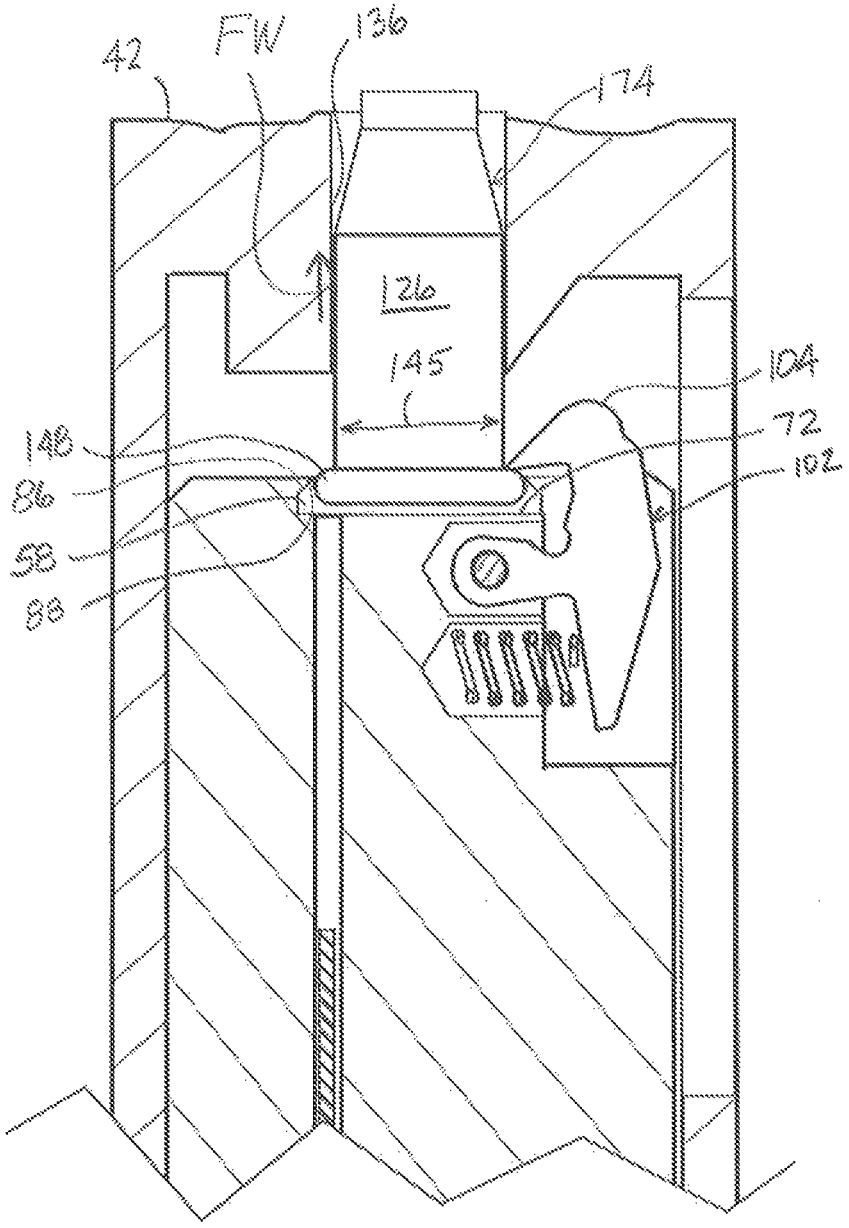
FIGS. 7A and 7B are sectional views of the bolt assembly, breech, and firing chamber for an extraction that could be associated with a non-blowback extraction at various stages of extraction in an embodiment of the disclosure.
Figure 7B:
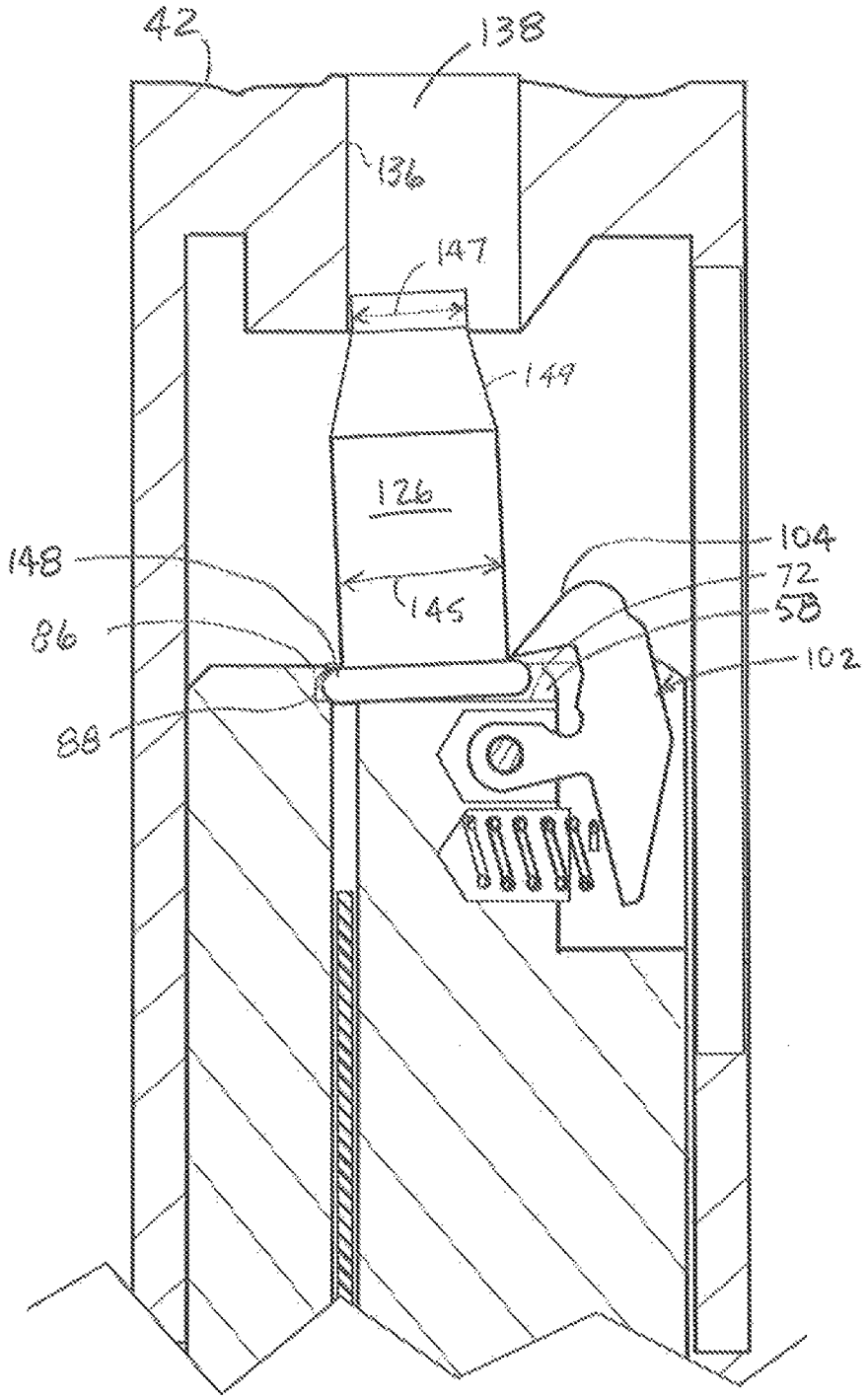

Referring to FIGS. 7A and 7B, certain stages of the extraction are depicted without the aid of a blowback force in an embodiment of the disclosure. Some firearms, such as bolt action or lever action firearms, do not benefit from blowback forces during extraction. Extraction for these devices is provided manually by the user, generally after the firing chamber as fully vented after discharge. The disclosed embodiments are operable without benefit of the blowback force, as depicted in FIGS. 7A and 7B.

Additionally, in semiautomatic firearms that do use blowback, at some point the inertia of the bolt assembly moving rearward and the frictional engagement of the casing with the firing chamber wall can overtake the rearward seating force of the cartridge casing, particularly after the pressurization of the firing chamber has dissipated, allowing separation to occur as shown in FIGS. 7A and 7B.

For a non-blowback extraction and potentially at a certain point in blowback extraction, the spent cartridge casing 174 can drag against the chamber wall 136 of the firing chamber 42 providing a frictional force FW. The drag FW can cause the spent cartridge casing 174 to rise off of the base surface 72 of the bolt face 54. The spent cartridge casing 174 is nevertheless retained within the recess 58 by the claw portion 104 of the claw extractor 102 during the initial stages of the extraction (FIG. 7A). As the major diameter 145 proceeds in the proximal direction 80, the radial inward force FCr exerted at the claw portion 104 pushes the rim 148 towards the ledge portion 86 opposite the claw portion 104, and the rim 148 is captured between the inclined face 88 and the base surface 72 (FIG. 7B). Thus, as the spent cartridge casing 174 clears the firing chamber 42, the spent cartridge casing 174 is held in equilibrium by the claw portion 104 and the ledge portion 86. The ejection of the spent cartridge casing 74 then proceeds as described and depicted attendant to FIG. 6E.

In some instances, the rim 148 can be canted within the recess 58 during the extraction, as depicted at FIG. 7B. The degree to which the rim 148 is canted depends on several factors, including the uncertainties in the size of the rim 148 and in the major diameter 145 introduced by machining tolerances, as well as variability in the frictional drag between the spent cartridge casing 174 and the firing chamber 42. While the precise orientation of spent cartridge casings may vary somewhat during the extraction process, the variability is within a small enough envelope so that the repeatability of the ejection is satisfactory.

Figure 8A:
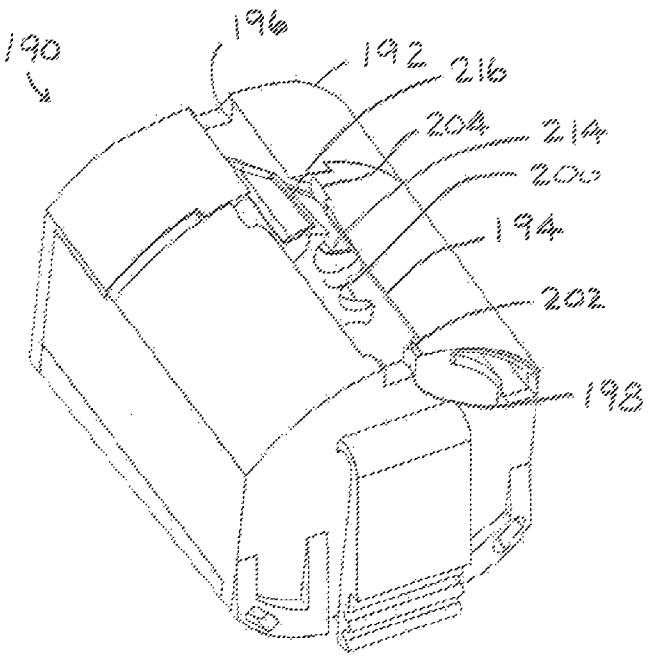
FIG. 8A is perspective views of a magazine for use in embodiments of the disclosure.
Figure 8B:
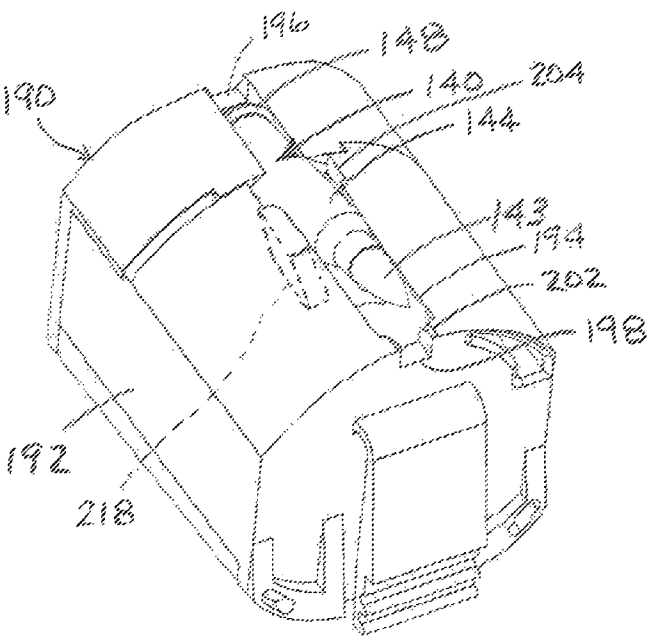
FIG. 8B is a perspective view of the magazine of FIG. 8A with a cartridge extending therefrom.

Referring to FIGS. 8A and 8B, a magazine 190 is depicted in an embodiment of the disclosure. The magazine 190 includes a housing 192 having an upper through-slot 194 formed thereon. The upper through-slot includes a proximal notch 196 and a distal notch 198. The distal notch 198 can further define shoulder portions 202 that lead into the upper slot 194. The upper slot 194 can also define a widened portion 204 disposed between the proximal and distal notches 196 and 198. A spool 206 is disposed within the housing 192, the spool 206 rotating about a spindle 208 (FIG. 9A) that is supported by the housing 192. In one embodiment, the spool is rotationally biased by a spring 212 (FIG. 9A) that is substantially concentric with the spindle 208. The spool 206 includes a plurality of pockets 214 formed in an outer-most radial surface 216 of the spool 206, each shaped to conform to the casing 144 of the cartridge 140.

In operation, as the spool 206 rotates about the spindle 208, the cartridge 140 encounters a ramp structure 218 (depicted in hidden lines) within the housing 192 that causes the bullet 143 of the cartridge 140 to protrude above the housing 192, while the rim 148 remains captured within the housing 192 in alignment with the proximal notch 196 of the upper slot 194 of the magazine 190 (FIG. 8B).

Figure 9A:
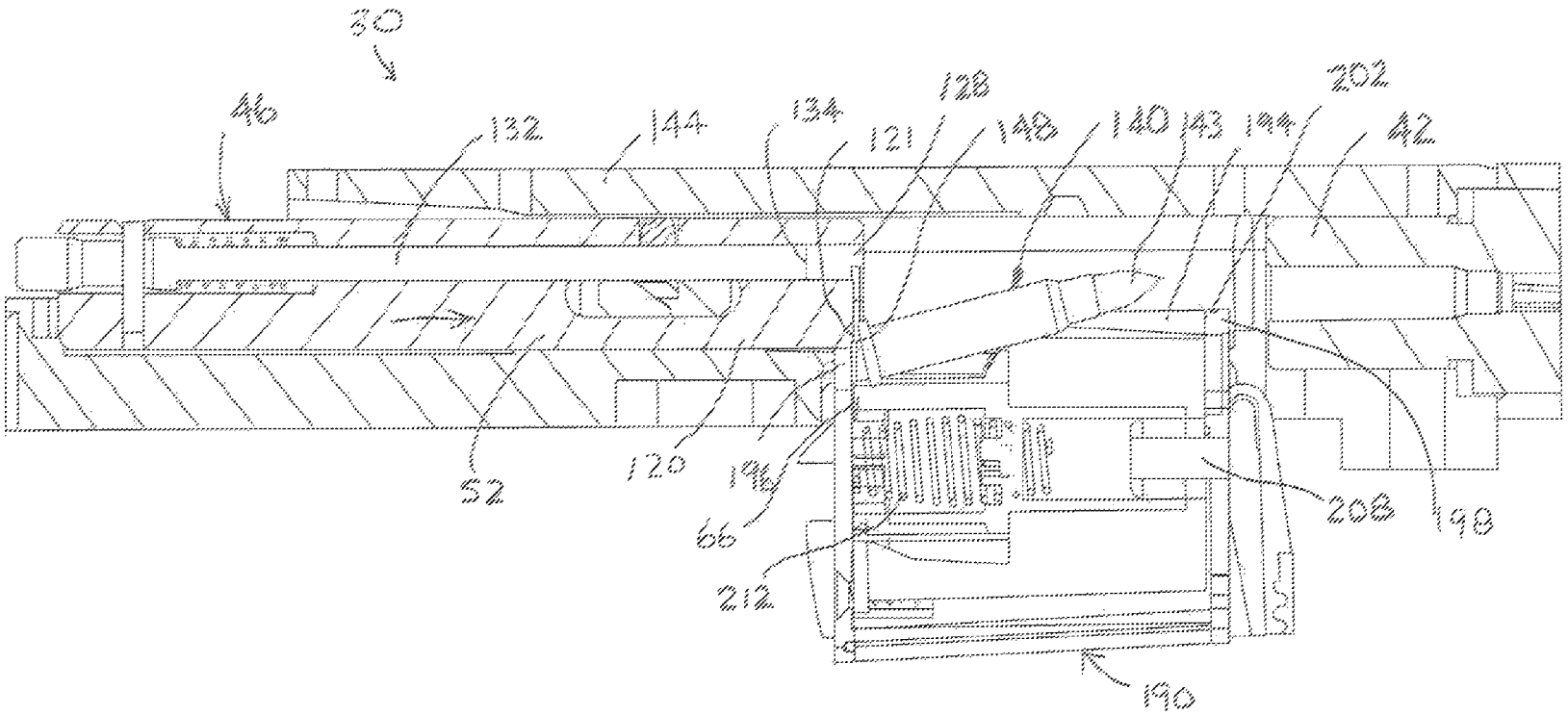
FIGS. 9A, 9B, 9E, and 9F are elevation sectional views of the firearm during a reloading sequence in an embodiment of the disclosure.
Figure 9B:
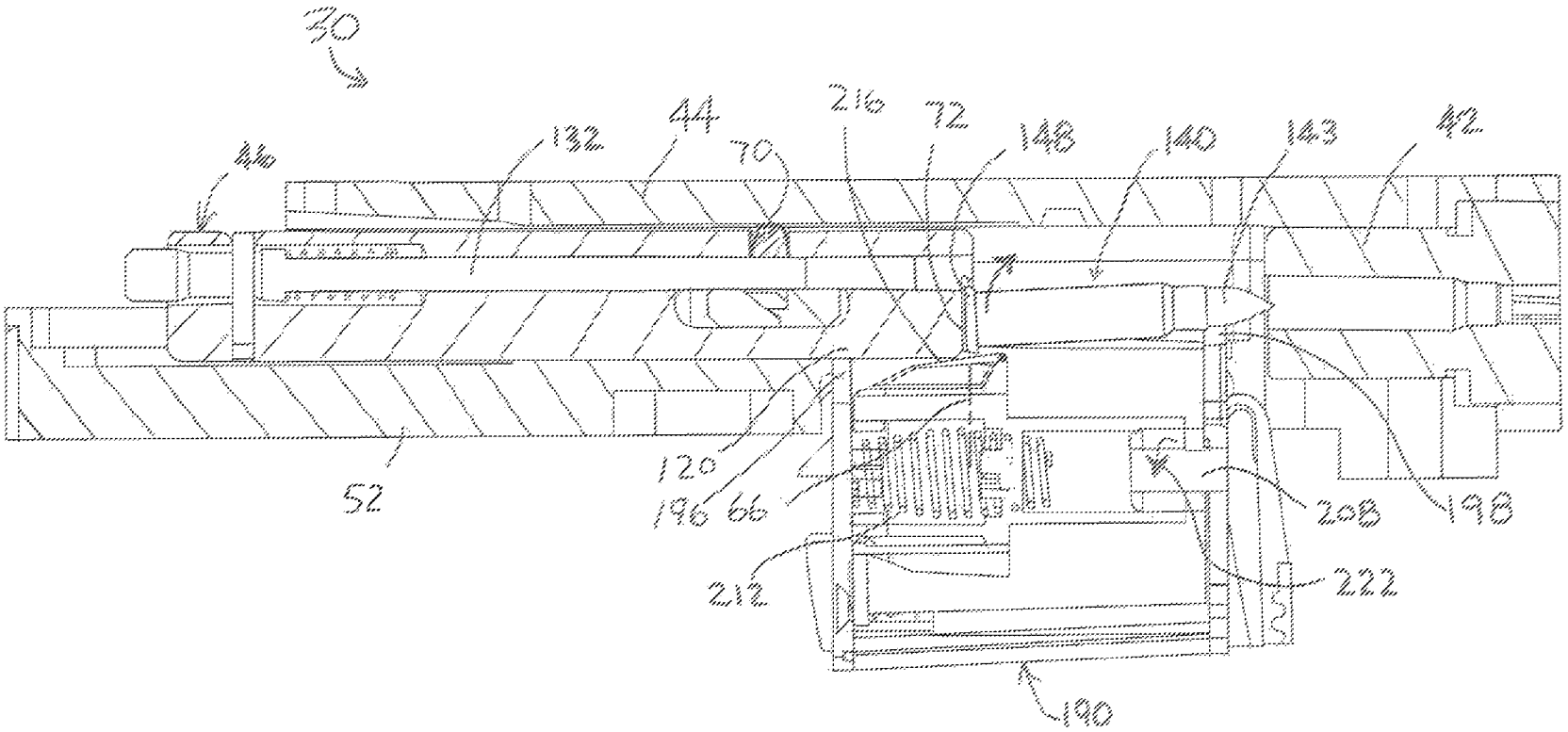

Referring to FIGS. 9A through 9F, operation of the bolt assembly 46 and magazine 190 during resupply the firing chamber 42 of the firearm 30 with another cartridge 140 are depicted in an embodiment of the disclosure. As the bolt 52 moves forward, the magazine rail 120 enters the proximal notch 196 of the upper slot 194 of the magazine 190, so that the distal face 121 of the magazine rail 120 makes contact with the rim 148 of the cartridge 140 (FIG. 9A).

The biasing spring 212 causes the spool 206 to exert an upward force on the rim 148, biasing the rim into the upper slot 194, as depicted in FIG. 8B. As the cartridge 140 moves in the distal direction 84, the rim 148 becomes aligned with the widened portion 204, and pops through the widened portion 204 due to the force exerted by the biasing spring 212. The biasing spring 212 further causes outer-most radial surface 216 of the spool 206 to rotate under the rim 148 of the cartridge 140, denoted by rotational arrow 222 in FIG. 9B. By this mechanism, the cartridge 140 is effectively stripped out of the magazine 190. The rotation 222 further elevates the rim 148, causing the rim 148 to enter the channel opening 68 and to be translated/rotated upward along the channel axis 66, sliding along the base surface 72. Because the bullet 143 of the cartridge 140 is elevated above the upper through-slot 194 of the magazine 190, the cartridge 140 makes sliding contact with the shoulder portions 202 of the distal notch 198 as the cartridge 140 is thrust forward by the bolt 52.

Figure 9C:
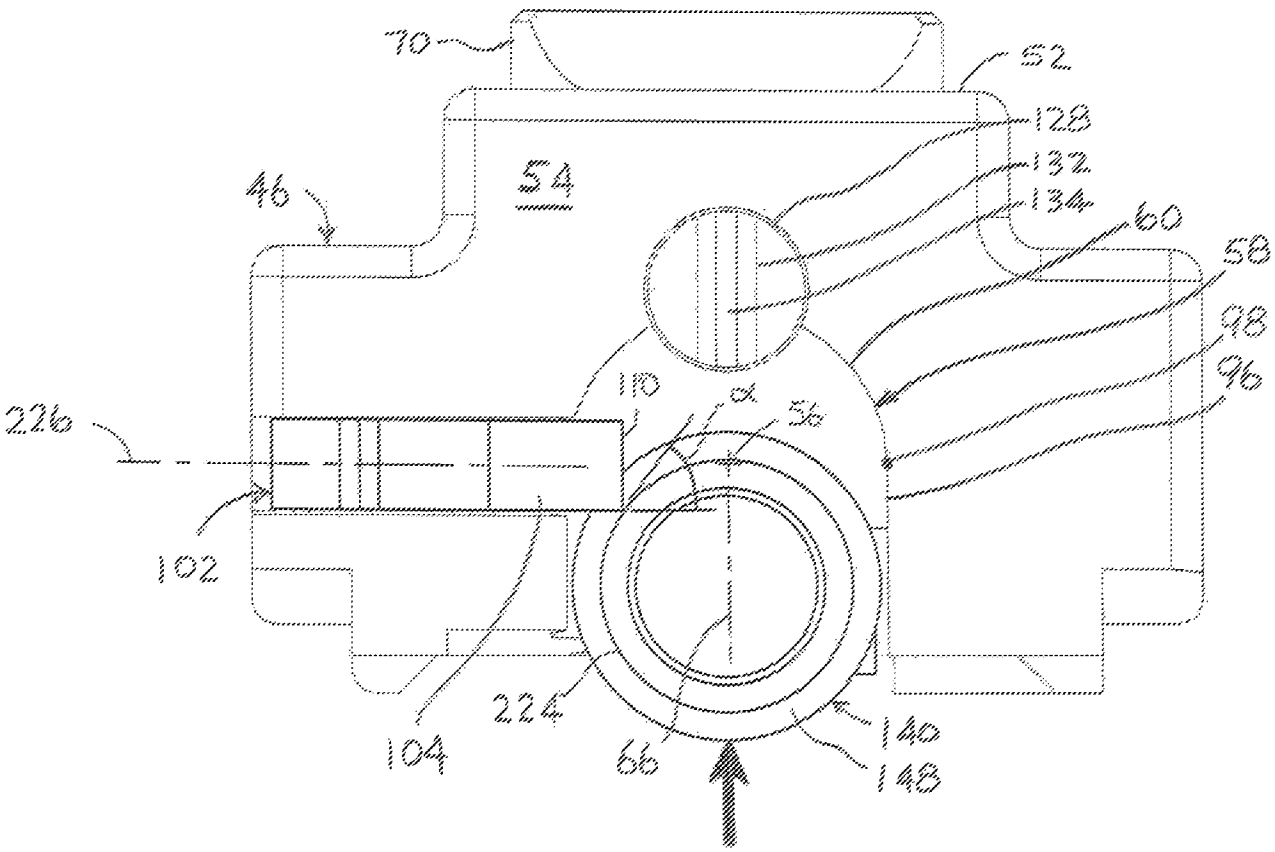
FIGS. 9C and 9D are front elevation views of the bolt assembly and the cartridge during the reloading sequence of the firearm in an embodiment of the disclosure.
Figure 9D:
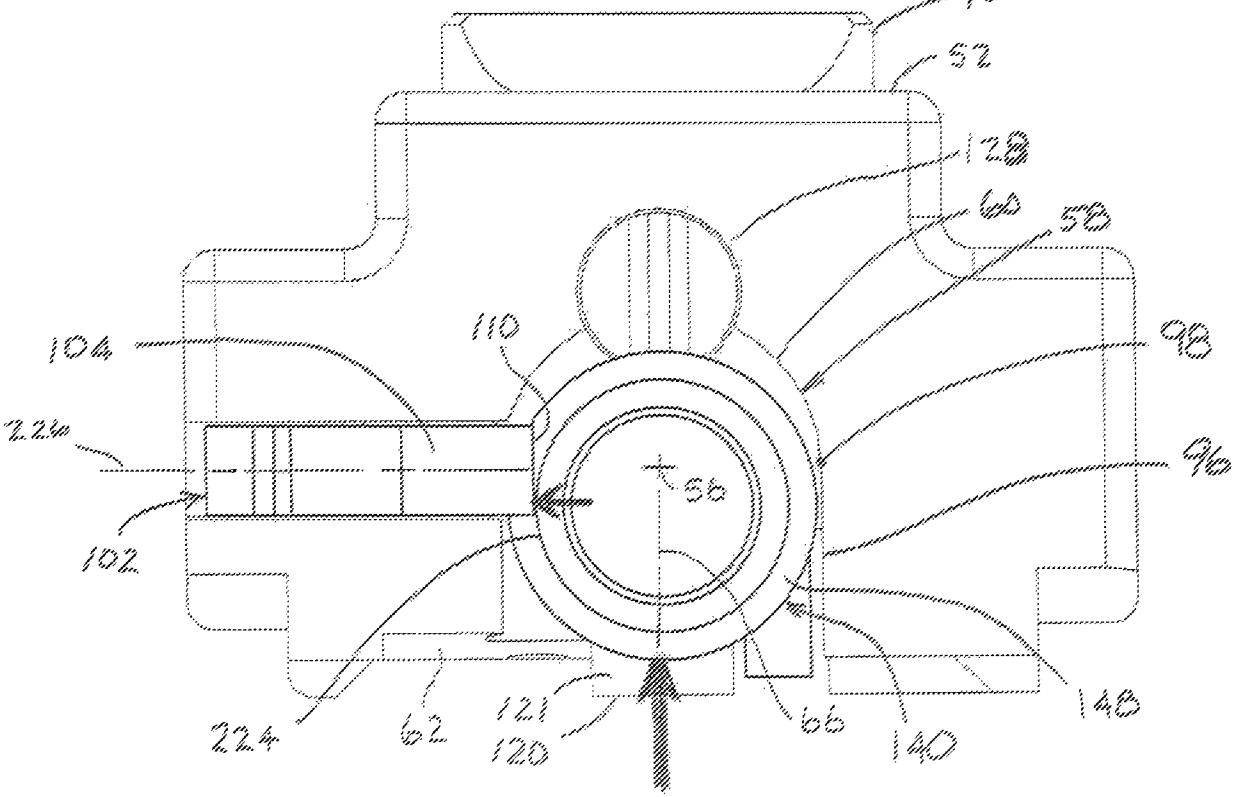

As the cartridge 140 is translated/rotated along the channel axis 66, an outer cylindrical surface 224 contacts the claw portion 104 of the claw-type extractor 102 at an acute angle $\alpha$ relative to an actuation axis 226 of the claw-type extractor 102 (FIG. 9C). The claw-type extractor 102 is thereby motivated away from the central axis 56 as the cartridge 140 slides into place within the recess 58 (FIG. 9D).

Figure 9E:
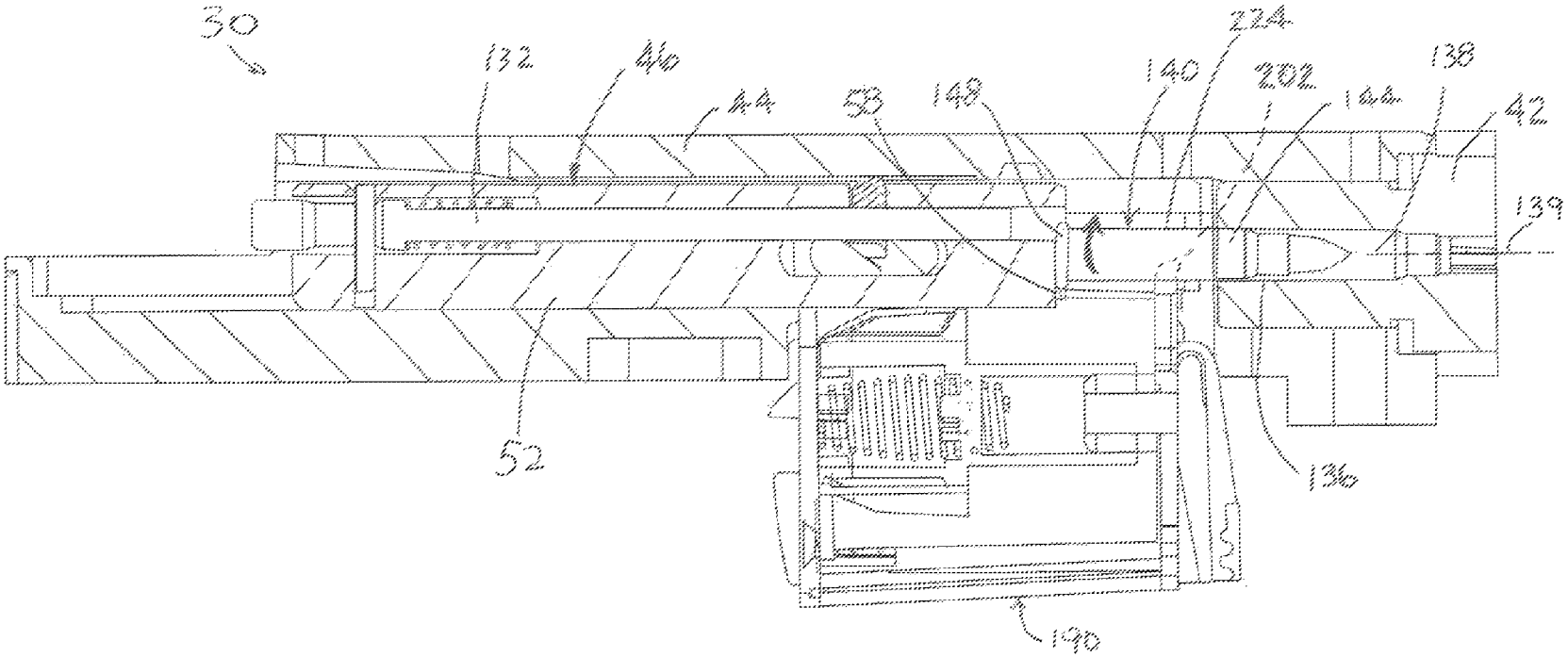

As the cartridge 140 continues to be thrust forward, the casing 144 rides up onto the shoulder portions 202 of the distal notch 198 of the magazine 190. As the cartridge 140 is pushed into the cylindrical interior chamber 138 of the firing chamber 42, the outer cylindrical surface 224 of the casing 144 comes into sliding contact with the chamber wall 136. Because of the close tolerance fit between the casing 144 and the chamber wall 136, the cartridge 140 becomes righted within the interior chamber 138 such that the cartridge 140 is in substantial alignment with the barrel axis 139 (FIG. 9E). The alignment causes the rim 148 of the cartridge 140 to rotate further upward into the recess 58 of the bolt 52.

Figure 9F:
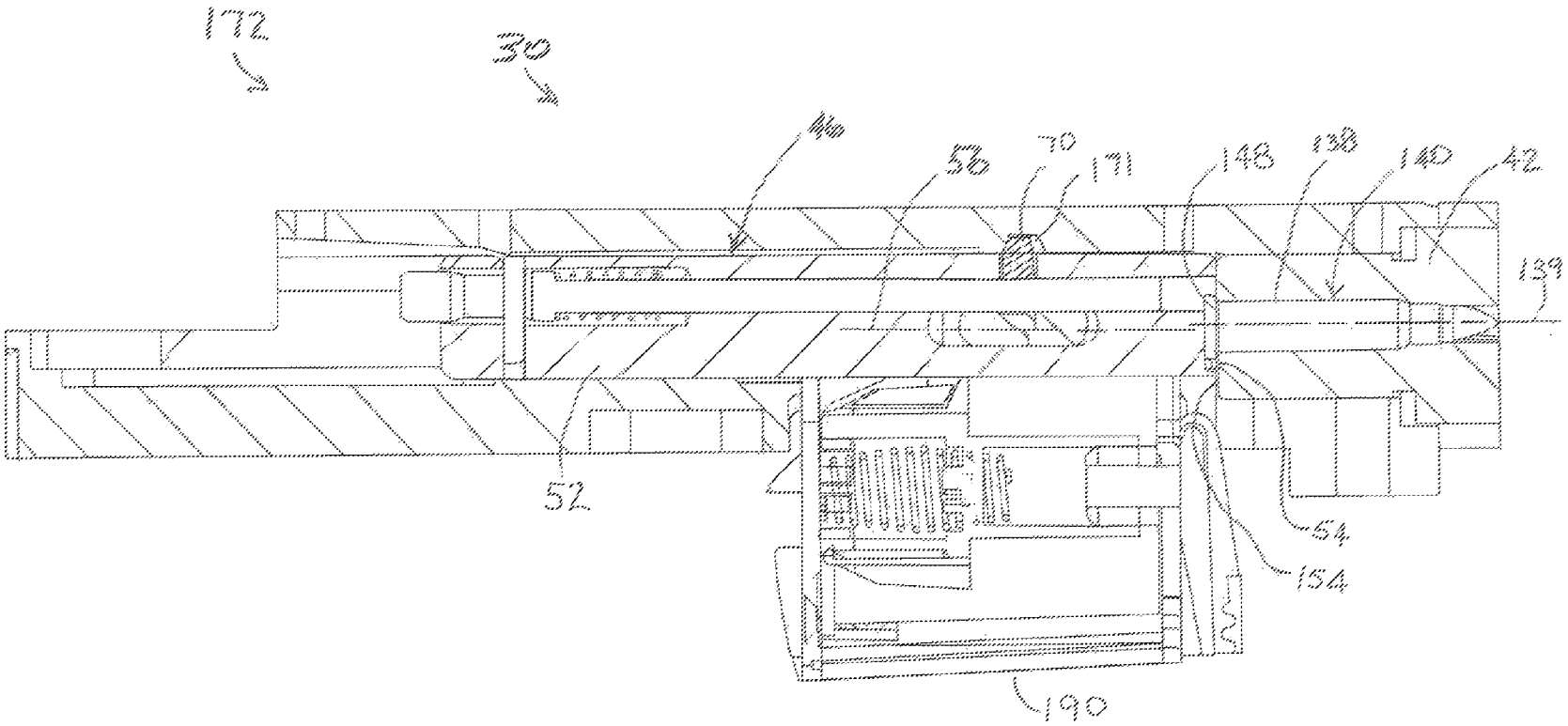

The bolt assembly 46 continues forward until the cartridge 140 is fully chambered within the firing chamber 42. As the bolt face 54 comes into pressing contact with the proximal end 154 of the firing chamber 42, the anchoring bar 170 extends into the anchoring slot 171 to secure the bolt 52 against the firing chamber 42 (FIG. 9F). The firearm 30 is thereby in the firing configuration 172 of FIGS. 6A through 6C, with the rim 148 captured by and in contact with the inclined face 88 of the ledge portion 86, as depicted in FIG. 6C.

It is noted that the foregoing figures do not, in all instances, reflect the actual scale of the various components relative to each other, nor do the figures always include all aspects of various components. That is, for the sake of illustration, certain components may be depicted as being shorter relative to other components. Also, the bolt assembly 46 can include other appurtenances typical to firearms that, for the sake of clarity and focus, are not depicted or described herein.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

When "linked", "coupled", and "connected" are used herein, the terms do not require direct component to component physical contact connection, one or more intermediary components may be present.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A semi-automatic firearm for firing rimfire ammunition, said firearm comprising:

a barrel defining a chamber for receiving and firing a rimfire cartridge;

a receiver operatively coupled to said barrel;

a bolt assembly operatively coupled to said receiver and adapted for loading, firing, and ejecting said rimfire cartridge, said bolt assembly defining and being translatable rearwardly along a central axis to a rearward position for withdrawal of a spent cartridge casing from said chamber and ejection of said spent cartridge casing, said bolt assembly being translatable from said rearward position forwardly for loading said rimfire cartridge from a magazine into said chamber, wherein said bolt assembly comprises:

a bolt body with a forward bolt face;

a recess defined on said forward bolt face for receiving a head of said rimfire cartridge, said recess being proximally bound by a base surface on said bolt face, said base surface being substantially normal to said central axis;

a ledge portion that partially surrounds said base surface of said bolt face, said ledge portion including an arcuate portion and a substantially straight portion tangential to said arcuate segment, said arcuate segment defining a radius about said central axis, said ledge portion including an inclined face that defines a normal vector including an axial component parallel to said central axis that is directed toward said base surface, said ledge portion being configured to accept a rim portion of said rimfire cartridge;

a retractable extractor disposed proximate said recess, said retractable extractor being extendable over said base surface, said retractable extractor being substantially centered at a location diametrically opposed to a junction point of said straight portion and said arcuate segment; and a firing pin that selectively extends into said recess in a direction normal to said base surface, said firing pin parallel to and non-concentric with said central axis to effect rimfiring of said rimfire cartridge.

2. The extraction mechanism of claim 1, wherein said axial component is in a range of 40 degrees and 70 degrees inclusive relative to said normal vector.

3. The extraction mechanism of claim 1, wherein said retractable extractor is a claw-type extractor.

4. A semi-automatic firearm, comprising:

a bolt assembly including:

a bolt with a bolt face, said bolt assembly defining a central axis and being translatable along said central axis;

a recess defined on said bolt face, said recess being proximally bounded by a base surface on said bolt face, said base surface being substantially normal to said central axis;

a ledge portion including an arcuate segment that partially surrounds said base surface of said bolt face, said arcuate segment defining a radius about said central axis, said ledge portion including an inclined face that defines a normal vector including an axial component parallel to said central axis that is directed toward said base surface;

a retractable extractor disposed proximate said recess, said retractable extractor being extendable over said base surface; and a firing pin that selectively extends into said recess in a direction normal to said base surface; and a firing chamber distal to said bolt assembly, said firing chamber being concentric about a barrel axis, wherein said central axis and said barrel axis are parallel and non-concentric for seating a rim of a rimfire cartridge against said inclined face of said ledge portion so that said rim is partially captured by said ledge portion when said bolt assembly is engaged with said firing chamber.

5. The firearm of claim 4, wherein:

said firing chamber includes structure defining a circular access opening and a ridge, said ridge including an edge that is immediately adjacent said circular access opening, wherein said retractable extractor engages said ridge to rotate said retractable extractor away from said recess when said firearm is in a firing position.

6. The firearm of claim 4, wherein said bolt assembly defines an off-axis bore that is parallel to and non-concentric with said central axis, said firing pin being disposed in said off-axis bore.

7. The firearm of claim 4, wherein said recess defines a channel and a channel opening on a lateral face of said bolt.

8. The firearm of claim 7, wherein said channel extends along a lateral axis that intersects said central axis.

* * * * *